US006376162B1

(12) United States Patent
Ishikawa et al.

(10) Patent No.: US 6,376,162 B1
(45) **Date of Patent: *Apr. 23, 2002**

(54) METHOD FOR PROCESSING SILVER HALIDE COLOR PHOTOGRAPHIC MATERIAL

(75) Inventors: Takatoshi Ishikawa; Kazuaki Yoshida; Hiroshi Fujimoto; Junichi Yamanouchi; Tomokazu Yasuda, all of Minami-ashigara (JP)

(73) Assignee: Fuji Photo Film Co., Ltd., Kanagawa-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/232,339

(22) Filed: Apr. 22, 1994

Related U.S. Application Data

(63) Continuation of application No. 07/781,245, filed on Dec. 27, 1991.

(30) Foreign Application Priority Data

Apr. 27, 1990 (JP) ..... 2-113635
Nov. 29, 1990 (JP) ..... 2-331415
Apr. 30, 1991 (JP) ..... PCT/JP91/00588

(51) Int. Cl.[7] ..... G03C 7/413
(52) U.S. Cl. ..... 430/486; 430/489
(58) Field of Search ..... 430/444, 467, 430/486, 487, 488, 489, 490, 491, 492, 493

(56) References Cited

U.S. PATENT DOCUMENTS

| | | | | |
|---|---|---|---|---|
| 4,960,684 A | * | 10/1990 | Ishikawa et al. | 430/491 |
| 4,965,175 A | * | 10/1990 | Fujimoto et al. | 430/489 |
| 5,066,571 A | * | 11/1991 | Yoshida et al. | 430/489 |
| 5,091,292 A | * | 2/1992 | Fujimoto et al. | 430/493 |
| 5,135,840 A | * | 8/1992 | Reuter et al. | 430/465 |
| 5,153,111 A | * | 10/1992 | Yoshida et al. | 430/444 |
| 5,264,330 A | * | 11/1993 | Yoshida et al. | 430/351 |
| 6,096,488 A | * | 8/2000 | Ishikawa et al. | 430/444 |

FOREIGN PATENT DOCUMENTS

| | | | | |
|---|---|---|---|---|
| EP | 0362795 | | 4/1990 | |
| JP | 4641676 | | 12/1971 | |
| JP | 4720743 | | 6/1972 | |
| JP | 5021250 | | 7/1975 | |
| JP | 35535 | * | 4/1978 | 430/444 |
| JP | 51742 | * | 5/1978 | 430/466 |
| JP | 5816179 | | 3/1983 | |
| JP | A 178257 | | 8/1987 | |
| JP | 62269957 | | 11/1987 | |
| JP | 6363044 | | 3/1988 | |
| JP | 63146032 | | 6/1988 | |
| JP | A 237059 | | 10/1988 | |
| JP | A 276050 | | 11/1988 | |
| JP | 63951 | | 3/1989 | |
| JP | 1105948 | | 4/1989 | |
| JP | 1298352 | | 12/1989 | |
| JP | 1303438 | | 12/1989 | |
| JP | 259743 | | 2/1990 | |
| JP | 77743 | * | 3/1990 | 430/466 |
| JP | 271264 | | 3/1990 | |
| JP | A-2077743 | | 3/1990 | |
| JP | 296156 | | 4/1990 | |
| JP | 2103538 | | 4/1990 | |
| JP | 2184850 | * | 7/1990 | 430/488 |
| JP | 2188751 | * | 7/1990 | 430/444 |
| JP | A-3-263043 | | 11/1991 | |

* cited by examiner

*Primary Examiner*—Hoa Van Le
(74) *Attorney, Agent, or Firm*—Sughrue Mion, PLLC

(57) ABSTRACT

In a processing method wherein, after a silver halide color photographic material is subjected to color development, the silver halide color photographic material is desilvered and then washed and/or stabilized, a photographic material that has at least one high-silver chloride emulsion layer, and in which at least one emulsion layer contains a monodisperse emulsion, is rapidly processed with a color developer having a water-soluble high polymer compound. The coating amount of silver of the said silver halide color photographic material is preferably 0.75 g/m$^2$ or less, and the color developer contains chloride ions in an amount of 0.035 mol/liter or more. In continuous and rapid processing, fluctuations of photographic properties (particularly changes in sensitivity and gradation) are remarkably reduced, the ununiformity of developed density is remarkably improved, and the occurrence of a deposit on a processing tank wall surface is prevented.

12 Claims, No Drawings

METHOD FOR PROCESSING SILVER HALIDE COLOR PHOTOGRAPHIC MATERIAL

This is a Continuation of Application Ser. No. 07/781,245 filed Dec. 27, 1991.

FIELD OF THE INVENTION

The present invention relates to a method for processing a silver halide color photographic material, and more particularly to a processing method wherein, in continuous processing, fluctuations of photographic properties (in particular changes in sensitivity and gradation) are remarkably reduced, ununiformity of developed density is remarkably improved, and prevention of a deposit on the processing tank wall surface is improved.

BACKGROUND OF THE INVENTION

In the method for processing silver halide color photographic materials, shortening of the processing time and reduction of the amount of a replenisher are becoming increasingly important issues in addressing recent demands to shorten the delivery of finished products and improve global-scale environmental problems. For such needs, a rapid processing technique and a low-replenishing processing technique wherein a high-silver chloride emulsion is used are disclosed in International Publication Patent No. WO 87/04534 and Japanese Patent Application (OPI) No. 70552/1986.

Indeed, increased rapidness and low replenishing were attained in these methods by using a high-silver chloride emulsion, but at the same time new problems arose. That is, along with the shortening of the developing time, photographic materials can be designed in such a way that desired photographic properties can be obtained even if development is not completed within the developing time, and therefore it is possible that before the completion of development the next desilvering step can be carried out. However, in such rapid and low-replenishing processing, contrarily a problem arises that a slight change in the development conditions (such as the pH of the developing solution and the concentration of the preservative) in the continuous processing is apt to change the finished photographic properties, and it is desired to provide some means which can solve the problem. Further, in such rapid processing, development proceeds during the time when the photographic material is carried from the color-developing bath to the next desilvering step (i.e., during the crossover) in the continuous processing, or the proceeding of the development changes when the photographic material touches a squeegee (a liquid remover) or conveying roller, and as a result ununiformity of developed density is often observed, and development of a technique for solving it is desired. Moreover another new problem has arisen that in the continuous processing deposits, such as the oxidation product of a developing agent, are liable to be formed on the wall surface of the development solution tank outside the solution and on the wall surfaces of racks near the solution interface, and scratch and stain are liable to occur, which is desired to be solved. It seems that this phenomena, as described in WO 87/04534, is attributed greatly to the composition of a color developer wherein, for example, sulfite ions and benzyl alcohol are removed.

On the other hand, as techniques prior to such rapid processing wherein a high polymer compound is added to a color developer, for example, techniques wherein celluloses are added are disclosed in Japanese Patent Publication Nos. 41676/1971 and 21250/1975, a technique wherein a pyrrolidone is added is disclosed in Japanese Patent Publication No. 20743/1972, and a technique wherein a polymer is added is disclosed in Japanese Patent Publication No. 16179/1983. In these techniques, the object of the high polymer compounds is not to allow a developing agent to become indissoluble and deposit in the developing solution or not to make the developing solution turbid, and therefore these techniques have a utterly different object from the present invention.

SUMMARY OF THE INVENTION

Therefore, an object of the present invention is to solve fluctuations of photographic properties at the time of continuous rapid processing and to solve ununiformity of developed density that will occur therein.

Another object of the present invention is to prevent the occurrence of deposits outside of the processing solution, such as on the wall surface of a processing tank.

It has been found that the objects of the present invention can be accomplished effectively by employing the following method.

(1) A method for processing a silver halide color photographic material wherein, after the silver halide color photographic material is subjected to color development, the silver halide color photographic material is desilvered and then washed and/or stabilized, characterized in that the photographic material which has at least one high-silver chloride emulsion layer, and in which at least one emulsion layer contains a monodisperse emulsion, is continuously processed with a color developer containing a water-soluble high polymer compound.

(2) The method for processing a silver halide color photographic material as stated in item (1), characterized in that the coating amount of silver in the said silver halide color photographic material is 0.75 $g/m^2$ or less.

(3) The method for processing a silver halide color photographic material as stated in item (1), characterized in that the said color developer contains chloride ions in an amount of 0.035 mol/liter or more.

The above effect for improving fluctuations of photographic properties and ununiformity of developed density is remarkable particularly when the coating amount of silver in the photographic material is 0.75 $g/m^2$ or less and it is noticeable that the effect is particularly remarkable even when the chloride ion concentration of the color developer is 0.035 mol/liter or more.

DETAILED DESCRIPTION OF THE INVENTION

The water-soluble high polymer compound of the present invention will now be described.

Preferable water-soluble high polymer compounds of the present invention are high polymer compounds obtained by homopolymerization or copolymerization of monomers having a copolymerizable ethylenically unsaturated group, polyesters, polyamides, polyurethanes, polyethers, polycarbonates, natural high polymer compounds, and their derivatives. Although there is no particular restriction on the molecular weight, preferably the molecular weight is in the range of 100 to 100,000. Above all, high polymer compounds obtained by homopolymerization or copolymerization of monomers having a copolymerizable ethylenically unsaturated group and polyether compounds are preferable.

More particularly, the water-soluble high polymer compounds obtained by homopolymerization or copolymerization of monomers having a copolymerizable ethylenically unsaturated group are preferably those having repeating units represented by the following formulae (I) to (V):

Formula (I)

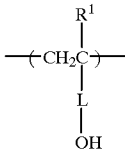

(a repeating unit having at least one hydroxyl group)

wherein $R^1$ represents a hydrogen atom or a lower alkyl group of 1 to 4 carbon atoms and L represents a single bond or a bivalent linking group, which may be substituted by one or more hydroxyl groups.

More particularly, $R^1$ represents a hydrogen atom or a lower alkyl group of 1 to 4 carbon atoms (e.g., methyl, ethyl, and n-butyl), with a hydrogen atom and a methyl group preferred. L can be specifically represented by $-(L^1)_m-(L^2)_n$. $L^1$ represents

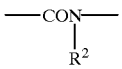

(wherein $R^2$ represents a hydrogen atom, an alkyl group of 1 to 4 carbon atoms, or a substituted alkyl group of 1 to 6 carbon atoms), —COO—, —NHCO—, —OCO—,

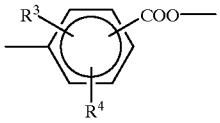

(wherein $R^3$ and $R^4$ each independently represent hydrogen, hydroxyl, a halogen atom, substituted or unsubstituted alkyl, alkoxy, acyloxy, or aryloxy),

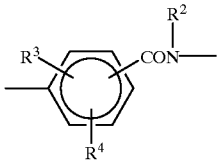

(wherein $R^2$, $R^3$, and $R^4$ have the same meanings as defined above), $L^2$ represents a linking group linking $L^1$ to the hydroxyl group, m is 0 or 1, and n is 0 or 1. The linking group represented by $L^2$ is specifically represented by a formula $-[X^1-(J^1-X^2)_p-(J^2-X^3)_q-(J^3)_r]_s$.

$J^1$, $J^2$, and $J^3$, which may be the same or different, each represent, for example, —CO—, $SO_2$—,

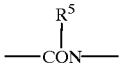

(wherein $R^5$ represents a hydrogen atom, an alkyl group (of 1 to 6 carbon atoms), a substituted alkyl group (of 1 to 6 carbon atoms),

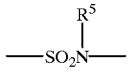

(wherein $R^5$ has the same meaning as defined above),

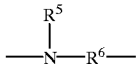

(wherein $R^5$ has the same meaning as defined above and $R^6$ represents an alkylene group of 1 to 4 carbon atoms),

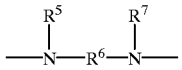

(wherein $R^5$ and $R^6$ have the same meanings as defined above, $R^7$ represents a hydrogen atom, an alkyl group (of 1 to 6 carbon atoms), or a substituted alkyl group (of 1 to 6 carbon atoms)), —O—, —S—,

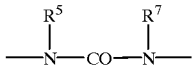

(wherein $R^5$ and and $R^7$ have the same meanings as defined above),

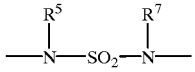

($R^5$ and $R^7$ have the same meanings as defined above), —COO—, —OCO—,

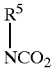

(wherein $R^5$ has the same meaning as defined above), or

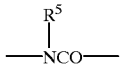

(wherein $R^5$ has the same meaning as defined above).

$X^1$, $X^2$, and $X^3$, which may be the same or different, each represent an alkylene group, a substituted alkylene group, an arylene group, a substituted arylene group, an aralkylene group, or a substituted aralkylene group. p is an integer of from 0 to 50 and q, r, and s are each 0 or 1. $X^1$, $X^2$, and $X^3$, which may be the same or different, each represent a substituted or unsubstituted linear or branched alkylene group having 1 to 10 carbon atoms, an aralkylene group, or a phenylene group. The alkylene group includes, for example, methylene, methylmethylene, dimethylmethylene, dimethylene, trimethylene, tetramethylene, pentamethylene, hexamethylene, and decylmethylene; the aralkylene includes, for example, benzylidene; and the phenylene group includes, for example, p-phenylene, m-phenylene, and methylphenylene.

As the substituents on the alkylene group, the aralkylene group, or the phenylene group represented by $X^1$, $X^2$, and $X^3$, can be mentioned a halogen atom, a nitro group, a cyano group, an alkyl group, a substituted alkyl group, an alkoxy group, a substituted alkoxy group, a group represented by —$NHCOR^8$ (wherein $R^8$ represents an alkyl, a substituted alkyl, a phenyl, a substituted phenyl, an aralkyl, or a substituted aralkyl), —$NHSO_2R^8$ (wherein $R^8$ has the same meaning as defined above), —$SO_2R^8$ (wherein $R^8$ has the same meaning as defined above), —$SO_2R^8$ (wherein $R^8$ has the same meaning as defined above), —$COR^8$ (wherein $R^8$ has the same meaning as defined above), a group represented by

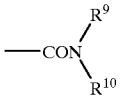

(wherein $R^9$ and $R^{10}$, which may be the same or different, each represent a hydrogen atom, an alkyl, a substituted alkyl, a phenyl, a substituted phenyl, an aralkyl, or a substituted aralkyl),

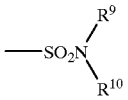

($R^9$ and $R^{10}$ have the same meanings as defined above), an amino group (which my be substituted by an alkyl group), a hydroxyl group, and a group that, when hydrolyzed, forms a hydroxyl group. When there are two or more of these substituents, they may be the same or different.

As examples of substituents of the above substituted alkyl group, substituted alkoxy group, substituted phenyl group, and substituted aralkyl group, can be mentioned a hydroxyl group, a nitro group, an alkoxy group of 1 to about 4 carbon atoms, a group represented by —$NHSO_2R^8$ (wherein $R^8$ has the same meaning as defined above) or —$NHCOR^8$ (wherein $R^8$ has the same meaning as defined above), a group represented by

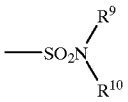

(wherein $R^9$ and $R^{10}$ have the same meanings as defined above) or

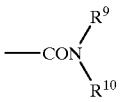

(wherein $R^9$ and $R^{10}$ have the same meanings as defined above), —$SO_2R$ (wherein $R^8$ has the same meaning as defined above), $COR^8$ (wherein $R^8$ has the same meaning as defined above), a halogen atom, a cyano group, and an amino group (which may have an alkyl group as a substituent).

Examples of such repeating units having at least one hydroxyl group are shown below, but the present invention is not restricted to them.

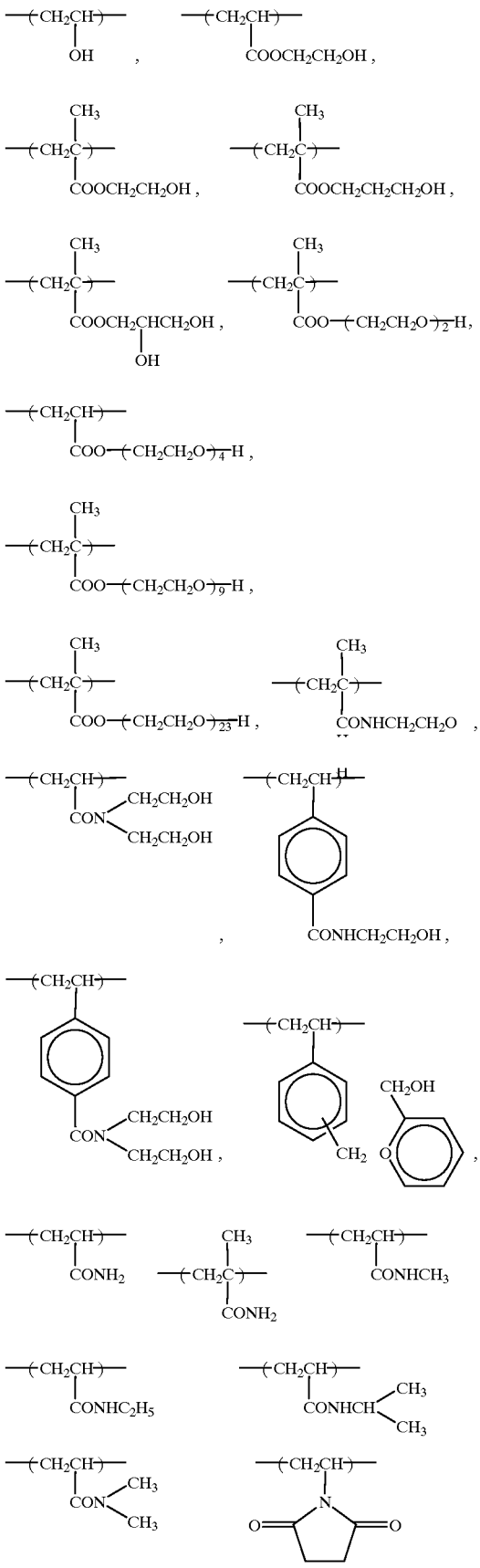

-continued

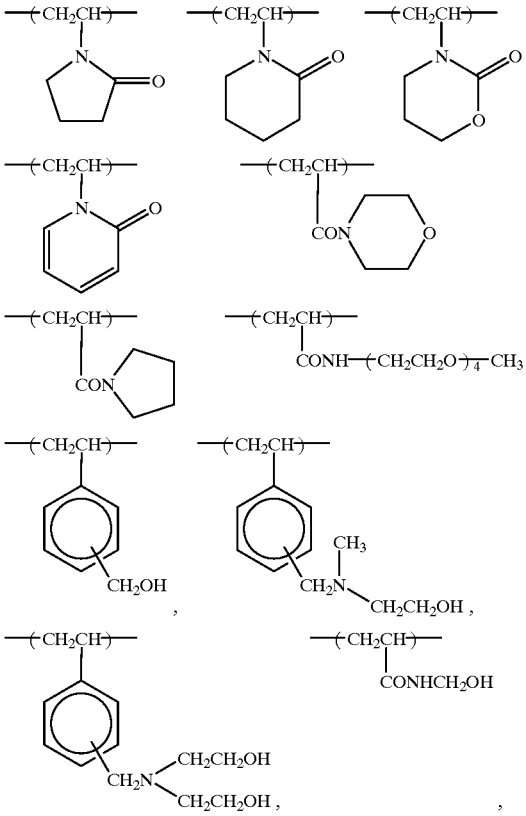

To obtain these repeating units having a hydroxyl group, an ethylenically unsaturated monomer having a hydroxyl group may be polymerized directly, or an ethylenically unsaturated monomer (e.g., vinyl acetate) that can give a hydroxyl group by a reaction such as hydrolysis may be polymerized followed by conversion to hydroxyl groups by a polymer reaction (e.g., hydrolysis) as well known in the production, for example, of polyvinyl alcohols.

Formula (II)

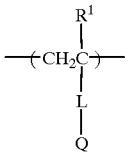

(a repeating unit having an anionic functional group)

wherein $R^1$ and L have the same meanings as defined in formula (I) given above.

L may be substituted by one or more Q's. Q represents an anionic functional group.

As the anionic functional group, a —COOH group, a —$SO_3H$ group, a —$SO_2H$ group, a

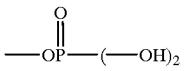

group, (or its monoalkyl ester group), or a group —$SO_3H$ can be mentioned. These anionic functional groups may be in the form of salts such as alkali metal salts (e.g., Na and K salts) and ammonium salts (e.g., ammonia salts, methineamine salts, and dimethylamine salts).

Examples of the ethylenically unsaturated monomers having an anionic functional group are shown below in undissociated form, but the present invention is not restricted to them.

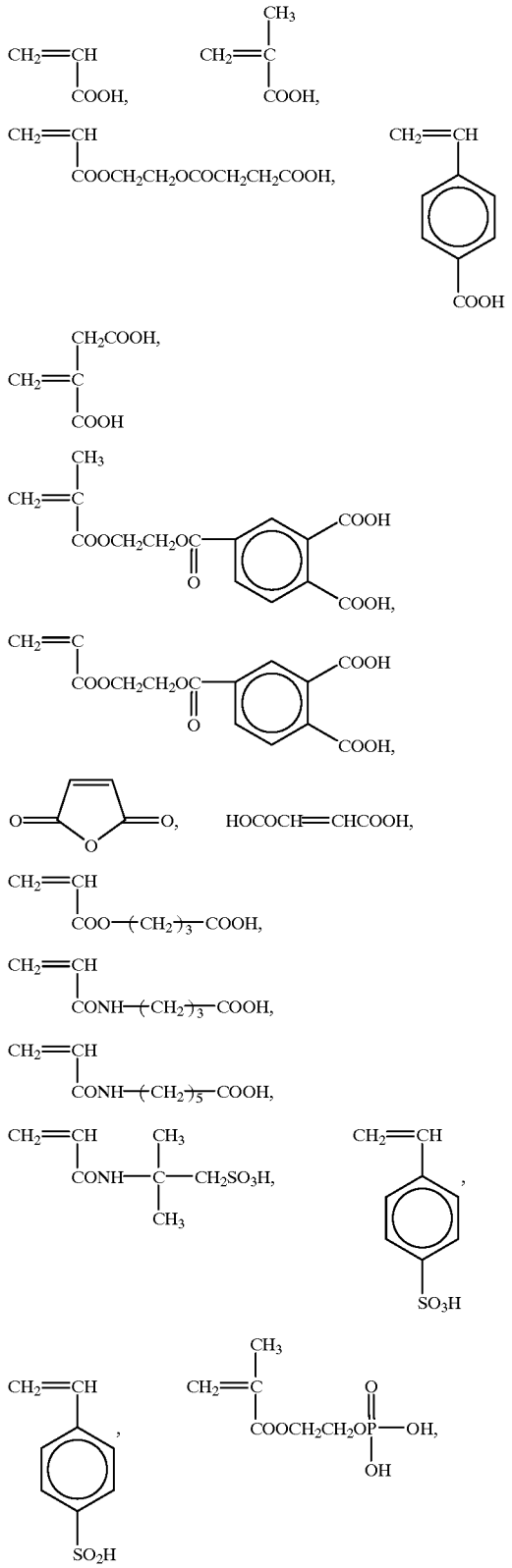

-continued

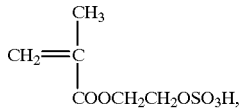

Formula (III)

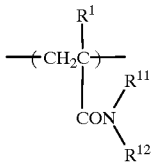

(a repeating unit (1) having an amide bond)

wherein $R^1$ has the same meaning as defined in formula (I) given above. $R^{11}$ and $R^{12}$ each represent a hydrogen atom, an alkyl group of 1 to 8 carbon atoms (including substituted alkyl groups), or an aryl group of 6 to 14 carbon atoms (including substituted aryl groups), or $R^{11}$ and $R^{12}$ may bond together to form a ring structure.

More particularly $R^{11}$ and $R^{12}$, which may be the same or different, each represent a hydrogen atom, an alkyl group of 1 to 8 carbon atoms (e.g., a methyl group, an ethyl group, a hydroxyethyl group, a butyl group, and an n-hexyl group), an aryl group of 6 to 14 carbon atoms (e.g., a phenyl group, a methoxyphenyl group, and a chlorophenyl group) and, out of these, a hydrogen atom, an alkyl group of 1 to 4 carbon atoms, and an aryl group of 6 to 10 carbon atoms are preferable, with a hydrogen atom, a methyl group, an ethyl group, and a hydroxyethyl group being more preferable.

Furthermore, most preferably at least one of $R^{11}$ and $R^{12}$ is a hydrogen atom.

When $R^{11}$ and $R^{12}$ bond together to form a ring structure, the formed ring is preferably 5- to 7-membered, and particularly preferable examples of the ring structures are a pyridine ring, a piperidine ring, a morpholine ring, and a piperazine ring. These formed ring structures may be substituted.

Formula (IV)

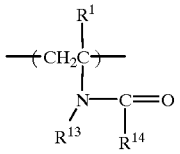

(a repeating unit (2) having an amide bond)

wherein $R^1$ has the same meaning as defined in formula (I) given above. $R^{13}$ and $R^{14}$ each represent a hydrogen atom or an alkyl group having 1 to 8 carbon atoms (including substituted alkyl groups), or they may bond together to form a lactam ring, an oxazolidone ring, or a pyridone ring (these ring structures may be substituted).

More particularly, $R^{13}$ and $R^{14}$, which may be the same or different, each represent a hydrogen atom, an alkyl group having 1 to 8 carbon atoms (e.g., a methyl group, an ethyl group, a hydroxyethyl group, a butyl group, and a hexyl group), or $R^{13}$ and $R^{14}$ are groups that bond together to form preferably a 5- to 7-membered oxazolidone ring (e.g., Γ-lactam, δ-lactam, and ϵ-lactam), a 5- to 7-membered oxazolidone ring, or a 5- to 7-membered pyridone ring. Out of these, particularly preferable are a hydrogen atom, a methyl group, and an ethyl group, and groups that form a pyrrolidone ring or an oxazolidone ring.

Formula (V)

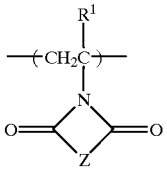

(a repeating unit (3) having an amide bond)

wherein $R^1$ has the same meaning as define in formula (I) given above. Z represents a group of atoms required to form a 5- to 7-membered ring structure, which may be substituted.

More particularly, Z preferably represents a group of atoms required to form a 5- or 6-membered ring structure (examples of the ring structure being a succinimido ring, a malonimido ring, and a phthalimido ring), with a succinimido ring being a particularly preferable formed ring structure.

Preferable specific examples of the repeating units having an amide bond used in the present invention are shown below, but the present invention is not restricted to them.

The water-soluble polymeric compounds of the present invention having repeating units represented by formulae (I) to (V) given above may be homopolymers or copolymers made up of two or more types of repeating units represented by two or more of formulae (I) to (V), or copolymers made up of two or more types of repeating units represented by one of formulae (I) to (V).

The water-soluble polymeric compounds may be copolymers with another monomer having an ethylenically unsaturated bond, which monomer is used in such an amount that the solubility of the copolymer to water or an aqueous alkali solution is not injured.

Examples of such a copolymerizable monomer having an ethylenically unsaturated bond are, in addition to monomers that can give repeating units represented by formulae (I) to (V) given above, an ester derived from an acrylic acid such as acrylic acid, α-chloroacrylic acid, and α-alkylacrylic acid (e.g., methacrylic acid) (e.g., methyl acrylate, ethyl acrylate, n-propyl acrylate, n-butyl acrylate, t-butyl acrylate, iso-butyl acrylate, 2-butylhexyl acrylate, n-octyl acrylate, lauryl acrylate, methyl methacrylate, ethyl methacrylate, n-butyl methacrylate, cyclohexyl methacrylate, β-alkoxyethyl acrylate or methacrylate (e.g., 2-methoxyethyl acrylate, 2-methoxyethyl methacrylate, 2-methoxyethyl acrylate, 2-ethoxyethyl acrylate, 2-ethoxyethyl methacrylate, 2-butoxyethyl acrylate, 2-n-propyloxyethyl methacrylate, and 2-(2-methoxy)ethoxyethyl acrylate), β-sulfonamidoethyl acrylate or methacrylate, β-carbonamidoethyl acrylate or methacrylate, or a compound represented by $CH_2{=}CH{-}C{-}(CH_2CH_2O)_nCH_3$ (n=2 to 50), a compound represented by

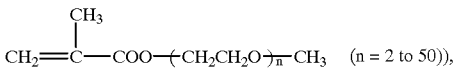

a vinyl ester (e.g., vinyl acetate and vinyl laurate), acrylonitrile, methacrylonitrile, dienes (e.g., butadiene and isoprene), an aromatic vinyl compound (e.g., styrene, divinyl benzene, and their derivatives, such as vinyltoluene, vinylacetophenone, and sulfostyrene), itaconic acid, citraconic acid, crotonic acid, vinylidene chloride, a vinyl alkyl ether (e.g., vinyl ethyl ether), maleic anhydride, a maleate, maleinamide, N-vinylpyridine, 2- and 4-vinylpyridine, ethylene, propylene, 1-butene, and isoproten. Among these monomers, preferable ones are those whose homopolymers are soluble in water or an aqueous alkali solution, and particularly preferable ones are ethylenically unsaturated monomers having an anionic dissociation group.

Although the copolymerization ratio of the repeating units represented by formulae (I) to (V) given above to the repeating units derived from monomers other than the former may vary depending on the polarity and the water-solubility of the used monomer component, preferably the repeating units represented by formulae (I) to (V) given above amount to 10 to 100 mol %, more preferably 30 to 100 mol %.

When the compound having a repeating unit represented by formulae (I) to (V) of the present invention is used for a copolymer, the copolymer may be, as is well known in the general radical polymerization reaction, a random copolymer or a graft copolymer or a block copolymer as described in Japanese Patent Application (OPI) No. 240763/1985.

For the synthesis of polymers having repeating units represented by formulae (I) to (V) of the present invention, use can be made of such known methods as solution polymerization, suspension polymerization, emulsion polymerization, precipitation polymerization, dispersion polymerization, and mass polymerization. Details may be referred to methods described, for example, in British Patent No. 1,211,039, Japanese Patent Publication No. 29195/1972, Japanese Patent Application (OPI) Nos. 76593/1973, 92022/1973, 21134/1974, and 120634/1974, British Patent No. 961,395, U.S. Pat. Nos. 3,227,672, 3,290,417, 3,262,919, 3,245,932, 2,681,897, and 3,230,275, and methods described by John C. Petropoulos et al. in Official Digest, Vol. 33, pp. 719 to 736 (1961), and by Shunsuke Murahashi in "Gosei Kobunshi," Vol. 1, pp. 246 to 290 and Vol. 3, pp. 1 to 108. Needless to say, the polymerization initiators, their concentrations, the polymerization temperature, the reaction time, etc., may be varied widely and readily depending on the purpose. For example, the polymerization can be carried out generally at 20 to 150° C., preferably 40 to 120° C., by using a radical polymerization initiator in an amount of 0.05 to 5 wt % for the monomer to be polymerized. Initiators include, for example, azobis compounds, peroxides, hydroperoxides, and redox catalysts, such as potassium persulfate, tert-butyl peroctoate, benzoyl peroxide, azobisisobutyronitrile, 2,2'-azobiscyanovaleric acid, and 2,2'-azobis-(2-amidinobrobane hydrochloride).

Polyether compounds preferably used in the present invention will now be described in detail. Preferably polyether compounds used in the present invention have repeating units represented by the following formula (VI):

Formula (VI)

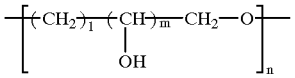

wherein 1 is an integer of 1 to 3, m is 0 or 1, and n is an integer of 2 to 100. Preferably n is 10 to 40, more preferably 15 to 30. Preferably m is 0.

Particularly preferably, in the compounds represented by formula (VI), m=0, 1=1.

Water-soluble polyamides, polyurethanes, and polycarbonates preferably used in the present invention have anionic functional groups (which are the same as Q in formula (II) given above), cationic functional groups (which are groups represented by formula (VII) given below) in the main chain and/or the side chains. Of these, particularly those having anionic functional groups are preferable.

Formula (VII)

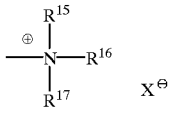

wherein $R^{15}$, $R^{16}$, and $R^{17}$, which may be the same or different, each represent a hydrogen atom or a lower alkyl group having 1 to 4 carbon atoms, which may be substituted by another functional group.

More particularly, $R^{15}$, $R^{16}$, and $R^{17}$ each represent a hydrogen atom or a lower alkyl group having 1 to 4 carbon atoms (e.g., a methyl group, an ethyl group, a propyl group, a butyl group, a 2-cyanoethyl group, a 2-hydroxyethyl group, and a 2-carboxylethyl group) and out of these a hydrogen atom, a methyl group, and a hydroxyethyl group are particularly preferable. It is the most preferable that at least one of $R^{15}$, $R^{16}$, and $R^{17}$ is a hydrogen atom.)

Preferable water-soluble natural high polymer derivatives used in the present invention are, for example, gelatin, gelatin derivatives (e.g., acylated gelatins and alkylated gelatins), graft polymers of gelatin with other polymers, proteins, such as albumin and casein and their derivatives; cellulose derivatives, such as hydroxyethyl cellulose, carboxymethyl cellulose, cellulose sulfate, and their salts; and saccharide derivatives such as sodium alginate, dextran, sucrose, and pullulan.

Examples of such repeating units having at least one hydroxyl group are shown below, but the present invention is not restricted to them.

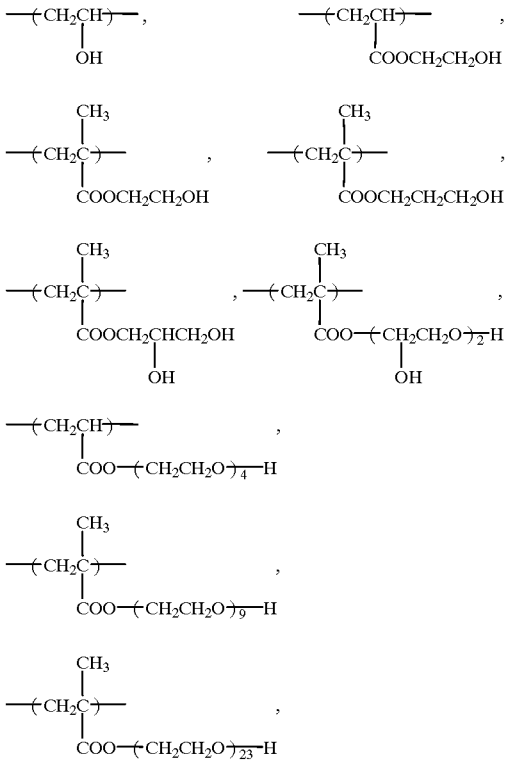

-continued

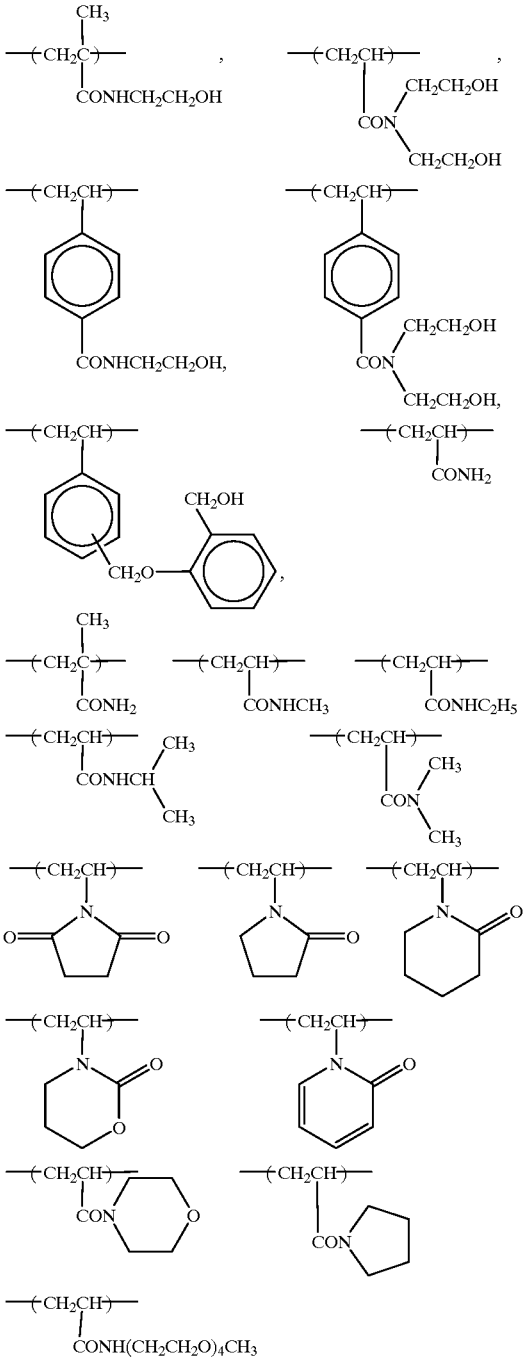

Specified examples of representative water-soluble high polymer compound to be used in the present invention are shown below, but the present invention is not limited to these specified samples.

EX-1 Poly(vinyl alcohol)
(Degree of saponification 98.5%)

EX-2 Poly(vinyl alcohol)
(Degree of saponification 74.0%)

EX-3 Poly(vinyl alcohol)—Poly(aclyric acid) block copolymer (100:50 in weight ratio)

EX-4 Poly(vinyl alcohol)—poly(aclyric acid)—(o-methacrylic acid) block copolymer (100:40:10 in weight ratio)

EX-5 Poly(vinyl alcohol)—polyacrylamide block copolymer (100:100 in weight ratio)

EX-6

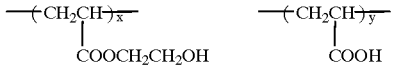

x/y = 60/40 (in weight ratio)

EX-7

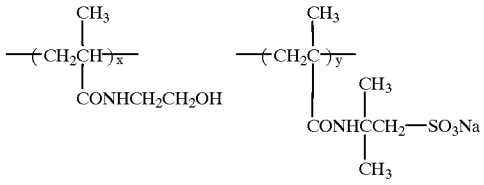

x/y = 60/40 (in weight ratio)

EX-8

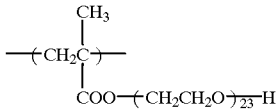

EX-9

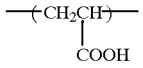

EX-10

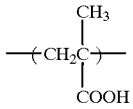

EX-11

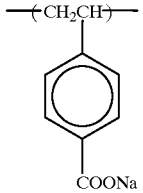

EX-12

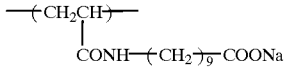

EX-13

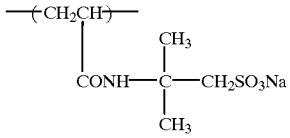

EX-14

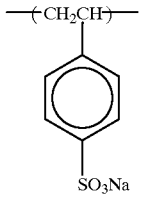

EX-15

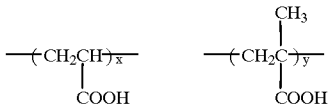

x/y = 50/50 (in weight ratio)

-continued

EX-16

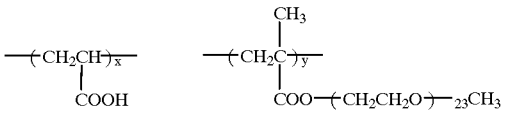

x/y = 95/5 (in weight ratio)

EX-17

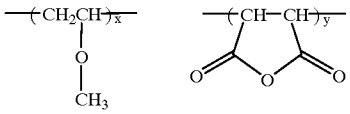

x/y = 95/5 (in weight ratio)

EX-18

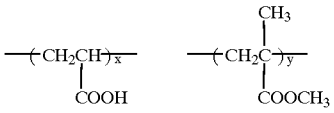

x/y = 90/10 (in weight ratio)

EX-19

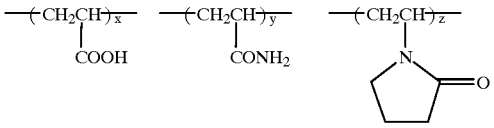

x/y/z = 50/25/25 (in weight ratio)

EX-20

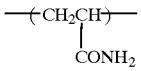

EX-21

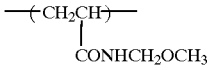

EX-22

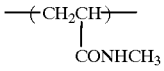

EX-23

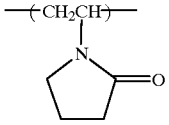

EX-24

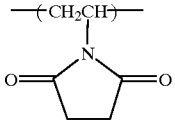

EX-25

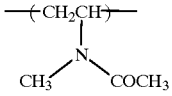

EX-26

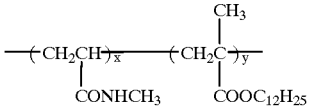

x/y = 90/10 (in weight ratio)

-continued

EX-27

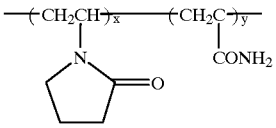

x/y = 50/50 (in weight ratio)

EX-28

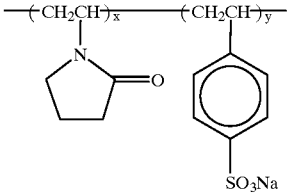

x/y = 80/20 (in weight ratio)

EX-29

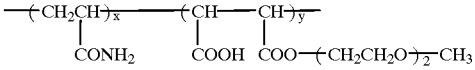

x/y = 75/25 (in weight ratio)

EX-30

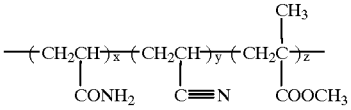

x/y/z = 85/10/5 (in weight ratio)

EX-31

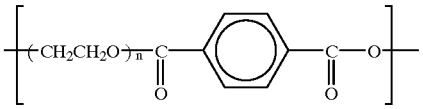

n = 20

EX-32

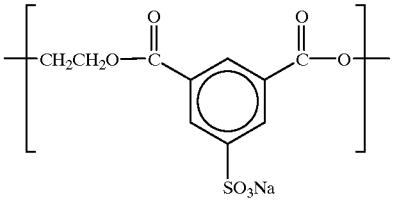

EX-33

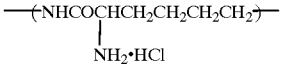

EX-34

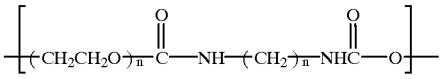

n = 35

EX-35

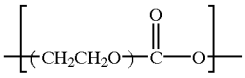

n = 13

EX-36 Poly(ethylene oxide)

Average degree of polymerization 50

EX-37 Poly(ethylene oxide)

Average degree of polymerization 20

EX-38 Gelatin

EX-39 Casein

EX-40 2-Hydroxyethyl cellulose

EX-41 Carboxymethyl cellulose

EX-42 Cellulose sulfate ester sodium salt

EX-43 Sodium alginate

EX-44 Dexstran

EX-45 Water-soluble starch

EX-46

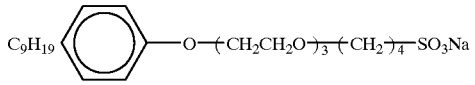

EX-47

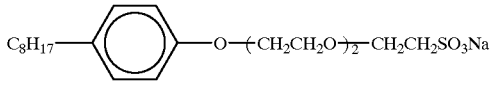

EX-48

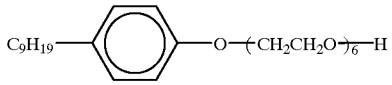

EX-49 $C_4H_9O-(CH_2CH_2O)_{10}H$

EX-50 $C_{16}H_{33}O-(CH_2CH_2O)_{10}H$

EX-51 $C_{16}H_{33}O-(CH_2CH_2O)_{20}H$

BX-51 $C_{16}H_{33}O-(CH_2CH_2O)_{10}-(CH_2CH_2CH_2O)_3H$

EX-52

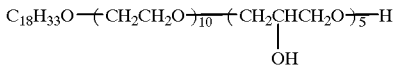

EX-53

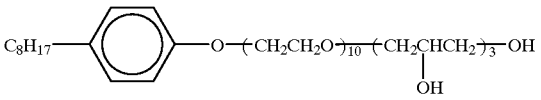

EX-54 $C_3H_7COO-(CH_2CH_2O)_{10}H$

EX-55 $CH_3O-(CH_2CH_2O)_8CH_3$

EX-56

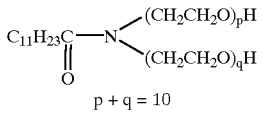

EX-57

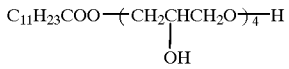

EX-58

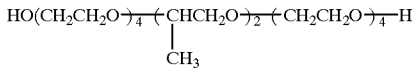

EX-59

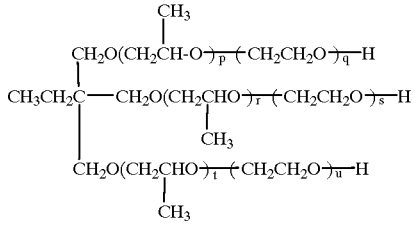

p, r, and t each are 1 or more.

q, s, and u each are 2 or more.

EX-60

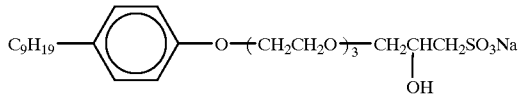

EX-61

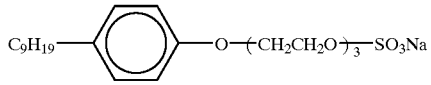

EX-62 $NaO_3SO-(CH_2CH_2CH_2-O)_6SO_3Na$

EX-63

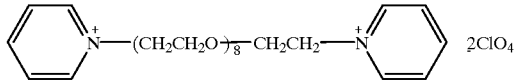

EX-64

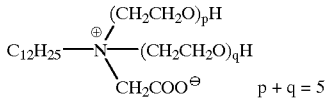

EX-65

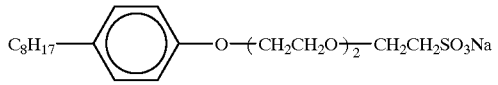

Among compounds represented by the above formulae, compounds represented by formulae (I), (II), (III), (IV), and (VI) are preferable, in particular, compounds represented by formulae (I), (II), and (IV) are most preferable. Specifically, compounds of EX-1, -2, -3, -4, -5, -6, -7, -8, -9, -10, -11, -12, -13, -14, -15, -16, -17, -18, -19, -46, -47, -49, -50, -52, -53, -60, and -65 are preferable, and compounds of EX-1, -2, -3, -4, -5, -6, -7, -8, -47, -49, -52, and -65 are particularly preferable.

The amount of these compounds to be added is 0.001 g to 10 g, preferably 0.01 g to 3 g, per liter of the color developer.

The color developer to be used in the present invention will be described below.

The color developer to be used in the present invention contains known aromatic primary amine color-developing agent. Preferred examples are p-phenylenediamine derivatives. Representative examples are given below, but they are not meant to limit the present invention:

D-1: N,N-diethyl-p-phenylenediamine

D-2: 2-amino-5-diethylaminotoluene

D-3: 2-amino-5-(N-ethyl-N-laurylamino)toluene

D-4: 4-[N-ethyl-N-(β-hydroxyethyl)amino]aniline

D-5: 2-methyl-4-[N-ethyl-N-(β-hydroxyethyl)amino]-aniline

D-6: 4-amino-3-methyl-N-ethyl-N-[β-(methanesulfonamido)ethyl]-aniline

D-7: N-(2-amino-5-diethylaminophenylethyl) methanesulfonamide

D-8: N,N-dimethyl-p-phenylenediamine

D-9: 4-amino-3-methyl-N-ethyl-N-methoxyethylaniline

D-10: 4-amino-3-methyl-N-ethyl-N-β-ethoxyethylaniline

D-11: 4-amino-3-methyl-N-ethyl-N-β-butoxyethylaniline

Of the above-mentioned p-phenylenediamine derivatives, 4-amino-3-methyl-N-ethyl-N-[β-(methanesulfonamido) ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol. Herein the term "substantially free from" means that the concentration of benzyl alcohol is preferably 2.0 ml/l or below, more preferably 0.5 ml/l or below, and most preferably benzyl alcohol is not contained at all.

It is more preferable that the developer for use in this invention is substantially free from sulfite ions. Sulfite ions are not preferable because of the occurrence of deposit on the wall surface of processing tank and the like due to sulfite ions. Herein the term "substantially free from" means that preferably the concentration of sulfite ions is $3.0\times10^{-3}$ mol/l or below, and most preferably sulfite ions are not contained at all.

However, in the present invention, a quite small amount of sulfite ions used for the prevention of oxidation of the processing kit in which the developing agent is condensed is excluded.

Preferably, the developer to be used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxyamine influences greatly the photographic properties. Herein the term "substantially free from hydroxylamine" means that preferably the concentration of hydroxylamine is $5.0\times10^{-3}$ mol/l or below, and most preferably hydroxylamine is not contained at all.

It is more preferable that the developer to be used in the present invention contains an organic preservative instead of above-described hydroxylamine or sulfite ions.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary ammonium salts, nitroxyradicals, alcohols, oximes, diamide compounds, and condensed cyclic amines are effective organic preservatives. These are disclosed, for example, in Japanese Patent Application (OPI) Nos. 4235/1988, 30845/1988, 21647/1988, 44655/1988, 53551/1988, 43140/1988, 56654/1988, 58346/1988, 43138/1988, 146041/1988, 44657/1988, and 44656/1988, U.S. Pat. Nos. 3,615,503 and 2,494,903, Japanese Patent Application (OPI) No. 143020/1977, and Japanese Patent Publication No. 30496/1973.

As the other preservative, various metals described in Japanese Patent Application (OPI) Nos. 44148/1982 and 53749/1982, salicylic acids described in Japanese Patent Application (OPI) No. 180588/1984, alkanolamines described in Japanese Patent Application (OPI) No. 3532/1979, polyethyleneimines described in Japanese Patent Application (OPI) No. 94349/1981, aromatic polyhydroxyl compounds described in U.S. Pat. No. 3,746,544 maybe included, if needed. It is particularly preferable the addition of alkanolamines, such as triethanolamine, dialkylhydroxylamines, such as diethylhydroxylamine, hydrazine derivatives, or aromatic polyhydroxyl compounds.

Among the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is more preferable in view of stability improvement of the color developer resulting its stability improvement during the continuous processing.

As the example of the above-mentioned amines cyclic amines described, for example, in Japanese Patent Application (OPI) No. 239447/1988, amines described, for example, in Japanese Patent Application (OPI) No. 128340/1988, and amines described, for example, in Japanese Patent Application Nos. 9713/1988 and 113000/1988.

Preferably the pH of the color developer of the present invention is in the range of 9 to 12, more preferably 9 to 11.0, and other known compounds that are components of a conventional developing solution can be contained.

In order to keep the above pH, it is preferable to use various buffers. As buffers, use can be made, for example, carbonates, phosphates, borates, tetraborates, hydroxylbenzoates, glycyl salts, N,N-dimathylglycinates, leucinates, norleucinates, guanine salts, 3,4-dihydroxyphenylalanine salts, alanine salts, aminobutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH 9.0 or higher, they do not adversely affect the photographic function (for example, to cause fogging), and they are inexpensive.

As specified samples of buffer, there are included sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l or more, and particularly preferably 0.1 to 0.4 mol/l.

In addition to the color developer can be added various chelating agents to prevent calcium or magnesium from precipitating or to improve the stability of the color developer. Specific examples are shown below: nitrilotriacetic acid, diethylenetriaminepentaacetic acid, ethylenediaminetetraacetic acid, N, N, N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamineortho-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid.

If necessary, two or more of these chelating agents may be used together.

With respect to the amount of these chelating agents to be added, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in Japanese Patent Publication Nos. 16088/1962, 5987/1962, 7826/1963, 12380/1969, and 9019/1970, and U.S. Pat. No. 3,813,247; p-phenylenediamine compounds disclosed in Japanese Patent Application (OPI) Nos. 49829/1977 and 15554/1975; quaternary ammonium salts disclosed, for example, in Japanese Patent Application (OPI) No. 137726/1975, Japanese Patent Publication No. 30074/1969, and Japanese Patent Application (OPI) Nos. 156826/1981 and 43429/1977; amine compounds disclosed, for example, in U.S. Pat. Nos. 2,494,903, 3,128,182, 4,230,796, and 3,253,919, Japanese Patent Publication No. 11431/1966, and U.S. Pat. Nos. 2,482,546, 2,596,926, and 3,582,346; polyalkylene oxides disclosed, for example, in Japanese Patent Publication Nos. 16088/1962 and 25201/1967, U.S. Pat. No. 3,128,183, Japanese Patent Publication Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chlorobenzotriazole, 2-thiazolyl-benzimidazole, 2-thiazolylmethyl-benzimidazole, indazole, hydroxyazaindolizine, and adenine.

Particularly, in the present invention, for the purpose of decreasing the fluctuation of photographic properties and decreasing the ununiformity of developed density, chloride ions are contained in an amount of 0.035 mol/l, preferably 0.04 to 0.15 mol/l.

Further, in the present invention, it is preferable, in the same reason as above described, that bromide ions are contained in an amount of $3\times10^{-5}$ to $1\times10^{-3}$ mol/l.

Herein, chloride ions and bromide ions may be added directly to the developer, or they may be allowed to dissolve out from the photographic material in the developer at the development processing.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Further, they may be supplied from a brightening agent that is added to the developer.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

It is preferable that the color developer that is adaptable in the present invention contains a brightening agent. As the brightening agent, 4,4'-diamino-2,2'-disulfostilbene compounds are preferable, which will be added in an amount of 0 to 5 g/l, preferably 0.1 to 4 g/l.

If required, various surface-active agents, such as alkylsulfonic acids, arylsulfonic acids, aliphatic carboxylic acids, aromatic carboxylic acids, and polyalkyleneimines may be added.

The processing temperature adaptable to the present invention is 20 to 50° C., preferably 30 to 40° C. The processing time is 20 sec to 5 min, and preferably 20 sec to 60 sec. Although it is preferable that the replenishing amount is as small as possible, it is suitable that the replenishing amount is 20 to 600 ml, preferably 50 to 300 ml, per $m^2$ of the photographic material. Further preferably it is 60 ml to 200 ml, most preferably 60 ml to 150 ml. This replenishing amount can be in the range from 20 to 120 ml.

The desilvering step adaptable to the present invention will now be described. Generally the desilvering step may be used any of the following steps: a bleaching step—a fixing step; a fixing step—a bleach-fixing step; a bleaching step—a bleach-fixing step; and a bleach-fixing step.

The bleaching solution, the bleach-fixing solution, and the fixing solution that are adaptable to the present invention will be described below.

As the bleaching agent for use in the bleaching solution or the bleach-fixing solution, use is made of any bleaching agents, but particularly it is preferable to use organic complex salts of iron (III) (e.g., complex salts of aminopolycarboxylic acids, such as ethylenediaminetetraacetic acid, diethylenetriaminepentaacetic acid; aminopolyphosphonic acids; phosphonocarboxylic acids; and organic phosphonic acids); organic acids, such as citric acid, tartaric acid, and malic acid; persulfates; and hydrogen peroxide.

Of these, organic complex salts of iron (III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium. Of these compounds, iron (III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion complex salts may be used in the form of a complex salts, or they may be formed in solution by using a ferric salt, such as ferric sulfate, ferric chloride, ferric nitrate, ammonium ferric sulfate, and ferric phosphate, and a chelating agent, such as aminopolycarboxylic acids, aminopolyphosphonic acids, and phosphonocarboxylic acids. The chelating agent may be used in excess to form the ferric ion complex salt. Of complex salts, aminopolycarboxylic acid iron complexes are preferable, and the amount thereof to be added is 0.01 to 1.0 mol/l, preferably 0.05 to 0.50 mol/l.

In the bleaching solution, the bleach-fix solution, and/or bath preceding them, various compounds may be used as a bleach accelerating agent. For example, compounds having a mercapto group or a disulfido group, described in the specifications of U.S. Pat. No. 3,893,858, German Patent No. 1,290,812, and Japanese Patent Application (OPI) No. 95630/1978, and Research Disclosure No. 17129 (July 1978), thiourea compounds described in Japanese Patent Publication No. 8506/1970, Japanese Patent Application (OPI) Nos. 20832/1977 and 32735/1978, and U.S. Pat. No. 3,706,561, or halides, such as iodide ion and bromide ion are preferable because of their excellent bleaching power.

In addition, the bleaching solution or the bleach-fix solution adaptable to the present invention may contain rehalogenating agents, such as bromides (e.g., potassium bromide, sodium bromide, and ammonium bromide), or chlorides (e.g., potassium chloride, sodium chloride, and ammonium chloride), or iodides (e.g., ammonium iodide). If necessary, one or more inorganic acids and organic acids or their alkali metal salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine can be added as a corrosion inhibitor.

The fixing agents to be used in the bleach-fixing solution or the fixing solution can use one or more of known fixing agents, that is, water-soluble silver halide solvents, for example, thiosulfates such as sodium thiosulfate and ammonium thiosulfate; thiocyanates, such as sodium thiocyanate and ammonium thiocyanate; thioether compounds, such as ethylenebisthioglycolic acid and 3,6-dithia-1,8-octanediol, and thioureas. Further, a special bleach-fixing solution comprising a combination of a fixing agent described in Japanese Patent Application (OPI) No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably in the range of 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution preferably contains, as a preservative, a compound that releases sulfite ions, such as sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.400 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents and mildew-proofing agents may be added.

Water-washing and/or stabilizing processing is conducted generally after the desilvering, such as the fixing or the bleach-fixing.

The amount of washing water in the washing step can be set over a wide range, depending on the characteristics of the photographic material (e.g., depending to the materials used, such as couplers), usage thereof, the washing water temperature, the number of the washing water tanks (stages), the type of replenishing, such as countercurrent type or down flow type, and other various conditions. The relationship between the number of washing water tanks and the amount of water in the multi-stage countercurrent system can be determined based on the method described in Journal of the Society of Motion Picture and Television Engineers, Vol. 64, pp. 248 to 253 (May 1955). Generally, the number of stages in the multi-stage countercurrent system is preferably 2 to 6, particularly preferably 2 to 4.

According to the multi-stage countercurrent system, the amount of washing water can be reduced considerably. For example, the amount can be 0.5 to 1 liter per $m^2$ of the photographic material, and the effect of the present invention is remarkable. But a problem arises that bacteria can propagate due to the increase in the retention time of the water in the tanks, and the suspended matter produced will adhere to the photographic material. To solve such a problem, the process for reducing calcium ions and magnesium described in Japanese Patent Application (OPI) No. 288838/1987 can be used quite. Further, isothiazolone compounds and thiabendazoles described in Japanese Patent Application (OPI) No. 8542/1982, chlorine-type bactericides, such as sodium chlorinated isocyanurates described in Japanese Patent Application (OPI) No. 120145/1986, benzotriazoles described in Japanese Patent Application (OPI) No. 267761/1986, copper ions, and bactericides described by Hiroshi Horiguchi in "Bokin Bobai-zai no Kagaku" (1986) published by Sankyo Shuppan, "Biseibutsu no Mekkin, Sakkin, Bobai Gijutsu" edited by Eiseigijutsu-kai (1982) published by Kogyogijutsu Kai, and "Bokin Bobai-zai Jiten" (1986) edited by Nihon Bokin Bobai-gakkai, can be used.

Further, the washing water can contain surface-active agents as a water draining agent, and chelating agents, such as represented by EDTA, as a water softener.

After the water-washing step mentioned above, or without the water-washing step, the photographic material may be directly processed with a stabilizing solution. In the stabilizing solution compounds that have an image-stabilizing function are added, and as examples thereof can be mentioned, for example, aldehyde compounds represented by formalin, buffers for adjusting the pH of film suitable to the image-stabilization, and ammonium compounds. Further, use can be made of the above-mentioned bactericides and anti-mildew agent for preventing bacteria from propagating in the solution, or for providing the processed photographic material with mildew-proof properties.

Further, surface-active agents, brightening agents, and hardening agents can also be added. In the processing of the photographic material of the present invention, if the stabilization is carried out directly without an water-washing step, known methods described, for example, in Japanese Patent Application (OPI) Nos. 8543/1982, 14834/1983, and 2203454/1985, can be used.

In addition, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as an water-washing solution or a stabilizing solution, used after the desilvering step.

The pH of the water-washing or a stabilizing step is preferably 4 to 10, more preferably 5 to 8. The temperature will vary depending on the usage and the properties of the photographic material and the like, and it generally will be 15 to 45° C., and preferably 20 to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in discharge, and the handleability.

The preferable replenishing amount per unit area of photographic material is 0.5 to 50 times, more preferably 3 to 40 times, amount of solution carried over from the preceding bath. In other words, it is 1 liter or less, preferably 500 ml or less, per $m^2$ of photographic material. Replenishing may be carried out either continuously or intermittently.

The liquid used in the water-washing step and/or stabilizing step can also be used in the preceding step. For example, it can be mentioned that saving is carried out by a multistage counter flow system by flowing the overflow of the washing water into the bleach-fix bath that precedes the washing step and the bleach-fix bath is replenished with a concentrate, so that the amount of the waste liquor can be reduced.

The color photographic material of the present invention can be constituted by applying at least one blue-sensitive silver halide emulsion layer, at least one green-sensitive silver halide emulsion layer, and at least one red-sensitive silver halide emulsion layer on a base. In common color photographic papers, the emulsion layers are applied on a base in the above-stated order, but the order can be changed. In these photosensitive emulsion layers, silver halide emulsions sensitive to respective wavelength regions, and dyes complementary to lights that they are sensitive to, so that they can form yellow for blue, magenta for green, and cyan for red, i.e., so-called color couplers, are contained respectively, so that color reproduction can be made by the subtractive color process.

The average grain size (the diameters of the circles equivalent to the projected areas of grains being assumed to be grain sizes and the number average thereof being taken) of silver halide grains contained in the silver halide emulsions used in the present invention is preferably $0.1\mu$ to $2\mu$.

The term "monodisperse silver halide grains" used in the present invention refers to silver halide grains wherein, when an electronmicrograph of the emulsion is observed, the shapes of the silver halide grains look uniform, the grain sizes are not scattered, and the ratio $S/\bar{r}$ of the standard deviation S of the grain diameter distribution to the average grain diameter $\bar{r}$ is 0.20 or below, preferably 0.15 or below. Herein, the standard deviation S of the grain distribution is found according to the following expression:

$$(S) = \sqrt{\frac{\sum(\bar{r} - r\ i)^2 n\ i}{\sum n\ i}}$$

Herein, if the silver halide grains are spherical, the average grain diameter $\bar{r}$ is the average of the diameters thereof, or if the silver halide grains are cubic or of shapes other than spherical shape, the average grain diameter $\bar{r}$ is the average of the diameters of circles having areas equal to areas of projected images of the grains, and $\bar{r}$ is defined by the following expression:

$$r = \frac{\sum n\ i\ r\ i}{\sum n\ i}$$

wherein ri represents the diameter of grains and ni is the number of the grains. The grain diameter can be measured by various methods used commonly in the art for the above purpose. Typical methods are described by R. P. Loveland in "Particle Diameter Analysis Table", A.S.T.M. Symposium On Light Microscopy, 1955, pp. 94 to 122, or by C. E. Kenneth Mees and T. H. James in "The Theory Of The Photographic Process," 3rd Edition, Chapter 2, Macmillan (1966). The grain diameter can be measured by using the projected areas or the approximate value of the diameters of the grains. When the grains are substantially uniform in shape, the grain diameter distribution can be expressed considerably accurately using the diameters or the projected areas.

The relation of grain diameter distributions can be determined by the method described in the literature by A. P. H. Trivelli and Smith in "Experimental Relations Between Distribution of Sensitometry And Distribution of Particle Diameter In Photographic Emulsion", The Photographic Journal Vol. LXXIX (1949) pp. 330 to 338.

The silver halide contained in the photographic emulsion layers of the color photographic material used in the present invention is silver bromochloroiodide, silver chloride, or silver bromochloride, containing about 30 mol % or less of silver bromide. Silver chloride or silver bromochloride containing about 0.1 to about 25 mol % of silver bromide is particularly preferable.

The coating amount of silver of the silver halide color photographic material of the present invention is 0.3 to 0.85 g, preferably 0.4 to 0.75 g, per $m^2$ of the photographic material.

In the silver halide emulsion used the present invention, various polyvalent metal impurities can be introduced during the process of forming or physically ripening the grains of the emulsion. As examples of compounds to be used, salts of cadmium, zinc, lead, copper, and thallium, or salts or complex salts of elements of Group VIII, such as iron, ruthenium, rhodium, palladium, osmium, iridium, and platinum, can be mentioned. Particularly, elements of Group VIII can be used preferably. Although the amount of these compounds to be added varies widely depending on the purpose, preferably the amount is $10^{-9}$ to $10^{-2}$ mol for the silver halide.

Generally the silver halide emulsion used in the present invention is chemically sensitized and also spectrally sensitized.

As the chemical sensitization, for example, sulfur sensitization, wherein typically an unstable sulfur compound is added, noble metal sensitization, typically gold sensitization, or reduction sensitization can be used alone or in combination. Compounds used in chemical sensitization are preferably those described in Japanese Patent Application (OPI) No. 215272/1987, page 18 (the right lower column) to page 22 (the right upper column).

Spectral sensitization is made for the purpose of providing the emulsion of each layer of the photographic material of the present invention with a spectral sensitivity to the desired light wavelength region. In the present invention, the addition of a dye that can absorb the light in the wavelength region corresponding to the intended spectral sensitivity, i.e., a spectral sensitizer, is preferable. As the spectral sensitizer thus used, those shown as CR compounds are preferably used, and also, for example, those described by F. M. Harmer in "Heterocyclic compounds-Cyanine dyes and related Compounds" (published by John Wiley & Sons [New York, London], 1964), can be mentioned. Specific examples of the compounds and spectral sensitization which are preferably used are described in the above-mentioned Japanese Patent Application (OPI) No. 215272/1987, page 22 (the right upper column) to page 38.

To the silver halide emulsion to be used in the present invention, various compounds or their precursors can be added for the purpose of preventing fogging during the process of the production of the photographic material, the storage thereof, or photographic processing thereof or for the purpose of stabilizing the photographic performance. Specific examples of these compounds are preferably those described in the above-mentioned Japanese Patent Application (OPI) No. 215272/1987, pages 39 to 72.

As the emulsion used in the present invention, use is made of a so-called surface-latent image-type emulsion, wherein a latent image is formed mainly on the grain surface, or of a so-called internal-latent image-type emulsion, wherein a latent image is formed mainly within the grains.

When the present invention is used for color photographic materials, generally in the color photographic material are used a yellow coupler, a magenta coupler, and a cyan coupler, which couple with the oxidized product of the aromatic amine color-developing agent to form yellow color, magenta color, and cyan color.

Cyan couplers, magenta couplers, and yellow couplers preferably used in the present invention are those represented by the following formulae (C-1), (C-II), (M-I), (M-II), and (Y):

Formula (C-I)

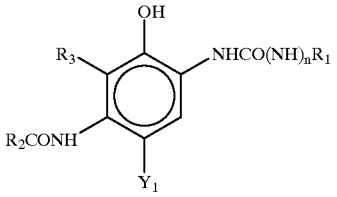

Formula (C-II)

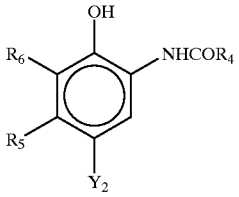

Formula (M-I)

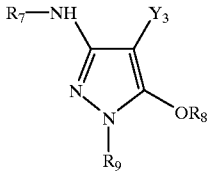

Formula (M-II)

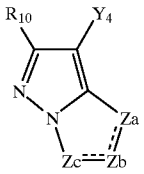

Formula (Y)

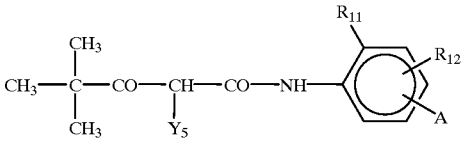

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group capable of releasing upon a coupling reaction with the oxidation product of a developing agent, and n is 0 or 1.

In formula (C-II), $R_5$ preferably represents an aliphatic group such as a methyl group, an ethyl group, a propyl group, a butyl group, a pentadecyl group, a tert-butyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group of 2 to 15 carbon atoms, and particularly preferably an alkyl group of 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that is released at one of a sulfur atom, an oxygen atom, and a nitrogen atom, and particularly preferably of the sulfur atom releasing type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a group capable of being released upon a coupling reaction, and particularly preferably a halogen atom or an arylthio group. Za, Zb, and Zc each represent methine, a substituted methine, =N—, or —NH—, and one of the Za–Zb bond and the Zb–Zc bond is a double bond, and the other is a single bond. If the Zb–Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4] triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in Japanese Patent Application (OPI) No. 65245/1976, pyrazoloazole couplers containing a sulfonamido group in the molecule, as described in Japanese Patent Application (OPI) No. 65246/1986, pyrazoloazole couplers having an alkoxyphenylsulfonamido ballasting group, as described in Japanese Patent Application (OPI) No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents —$NHCOR_{13}$, —$NHSO_2$—$R_3$, —$SO_2NHR_{13}$, —$COOR_{13}$, or

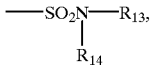

wherein $R_{13}$ and $R_{14}$ each represent an alkyl group, an aryl group, or an acyl group. $Y_5$ represents a group capable of being released. Substituents of $R_{12}$, $R_{13}$, and $R_{14}$ are the same as those allowable for $R_1$, and $Y_5$, the group capable of being released, is of the type that will be released preferably at an oxygen atom or a nitrogen atom, and particularly preferably it is of the nitrogen atom releasing type.

Specific examples of couplers represented by formulae (C-I), (C-II), (M-I), (M-II) and (Y) are listed below.

(C-1)

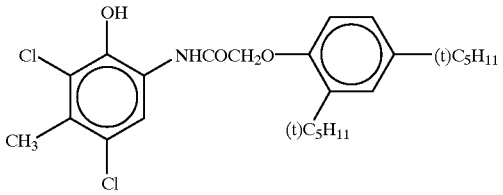

(C-2)

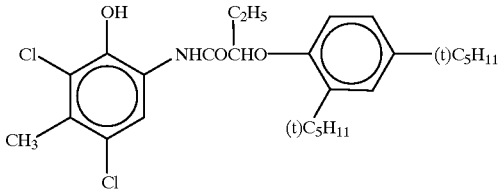

-continued (C-3)

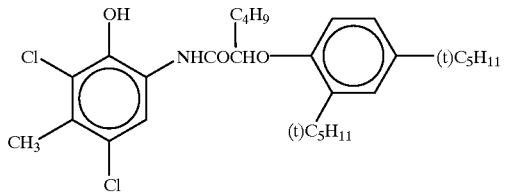

(C-4)

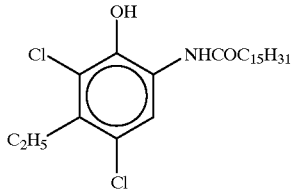

(C-5)

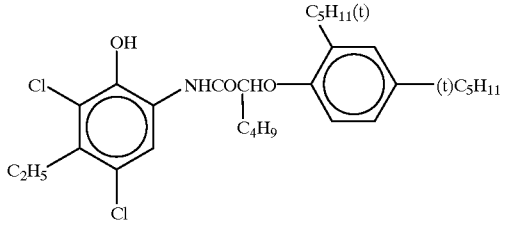

(C-6)

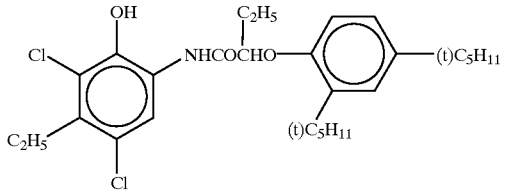

(C-7)

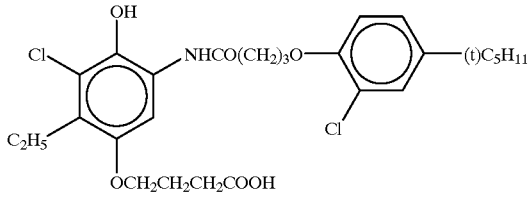

(C-8)

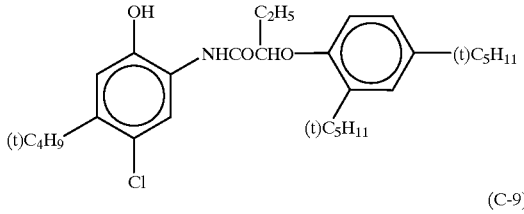

(C-9)

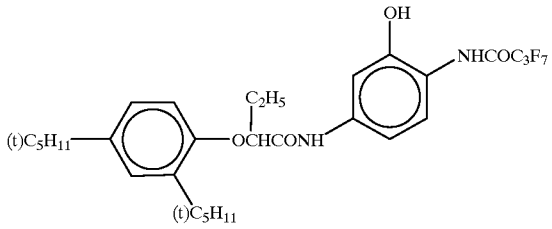

-continued
(C-10)
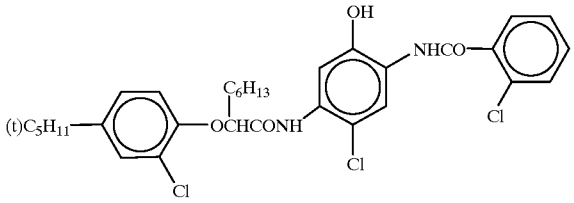
(C-11)
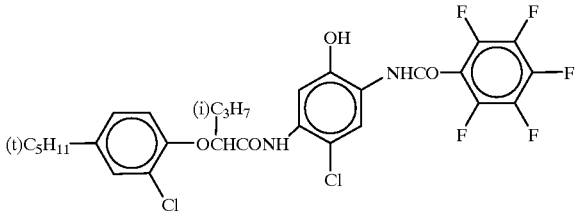
(C-12)
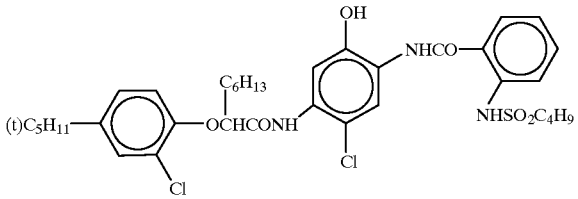
(C-13)
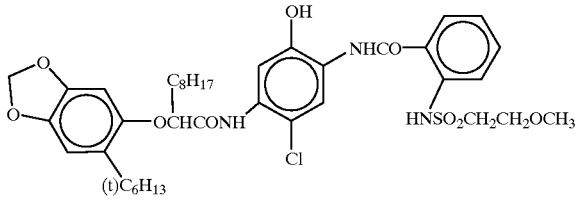
(C-14)
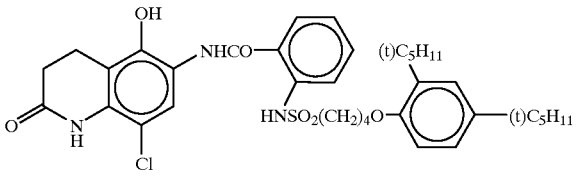
(C-15)
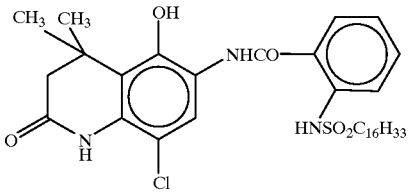
(C-16)
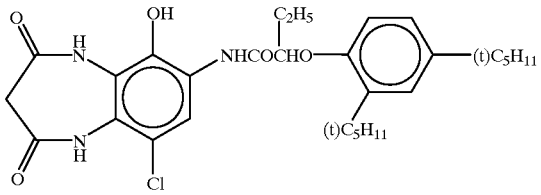
-continued
(C-17)
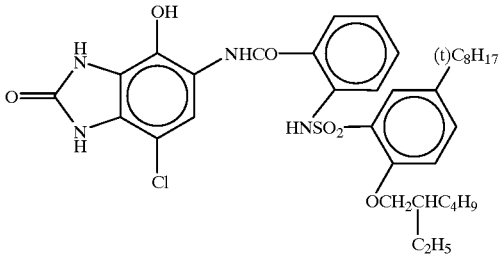
(C-18)
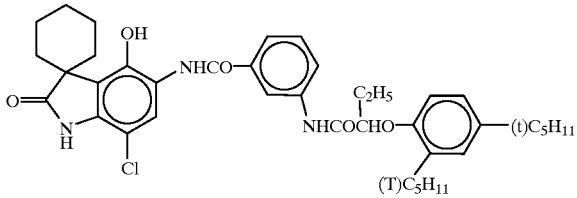
(C-19)
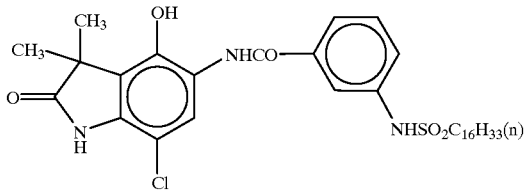
(C-20)
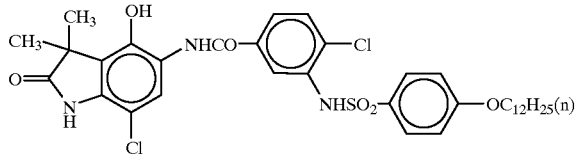
(C-21)
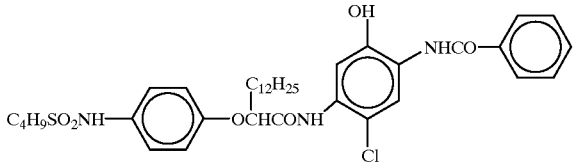
(C-22)
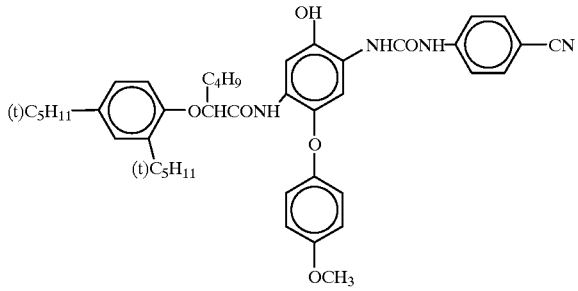

-continued
(M-1)
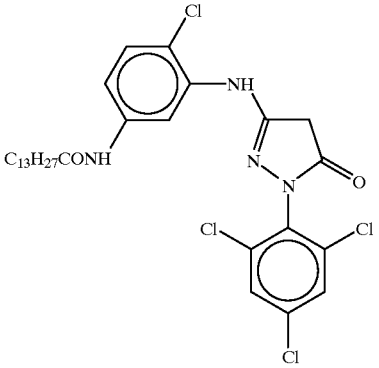
(M-2)
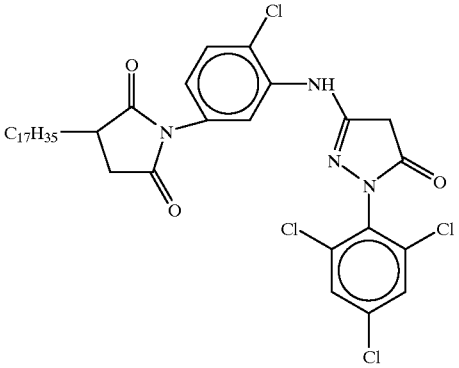
(M-3)
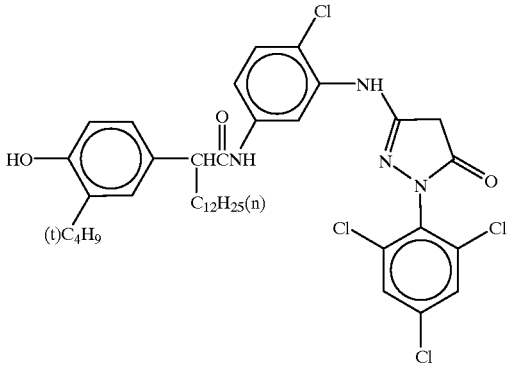
(M-4)
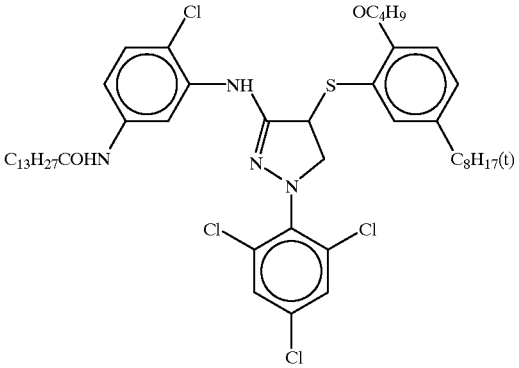
-continued
(M-5)
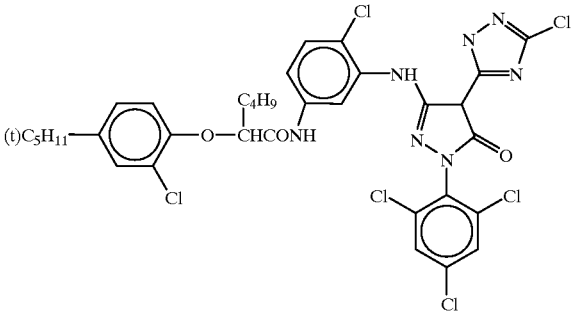
(M-6)
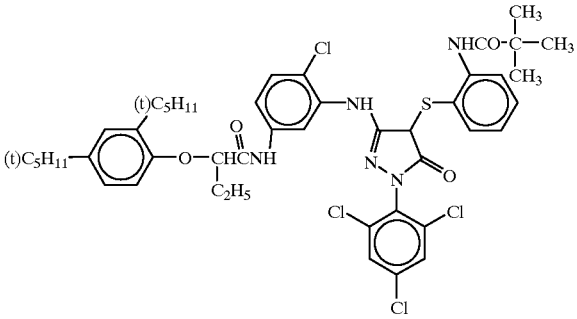
(M-7)
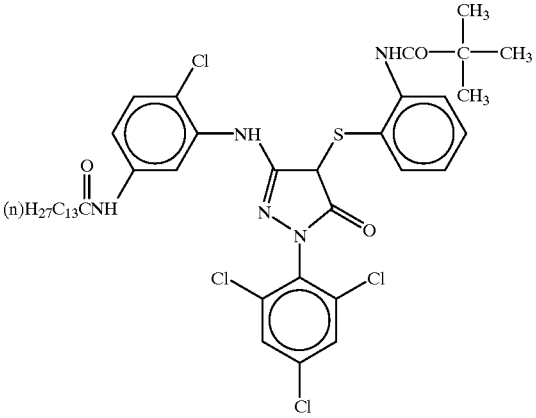
(M-8)
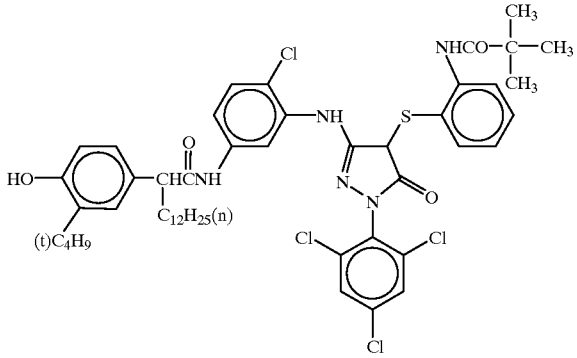

| Compound | $R_{10}$ | $R_{15}$ | $Y_4$ |
|---|---|---|---|
| | | 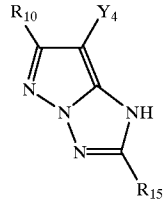 | |
| M-9 | $CH_3$— | 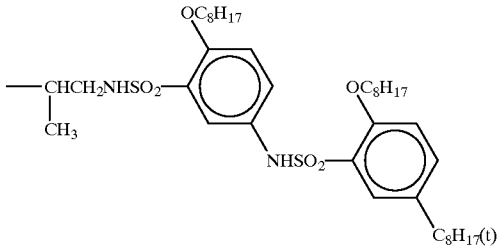 | Cl |
| M-10 | The same as the above | 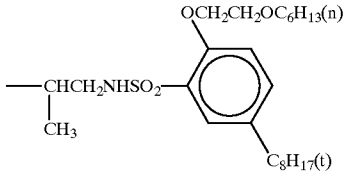 | The same as the above |
| M-11 | $(CH_3)_3C$— | 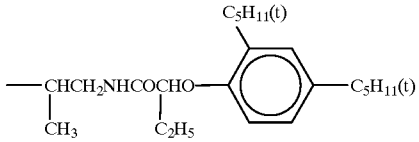 | 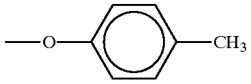 |

-continued
| Compound | $R_{10}$ | $R_{15}$ | $Y_4$ |
|---|---|---|---|
| M-12 | 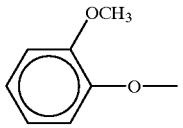 | 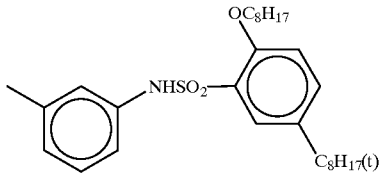 | 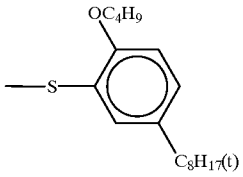 |
| M-13 | $CH_3$— | 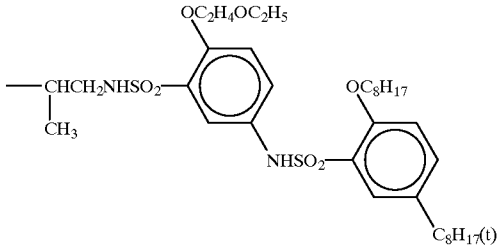 | Cl |
| M-14 | The same as the above | 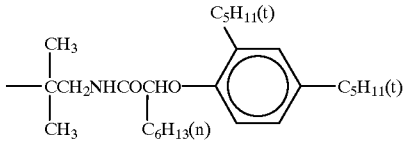 | The same as the above |
| M-15 | The same as the above | 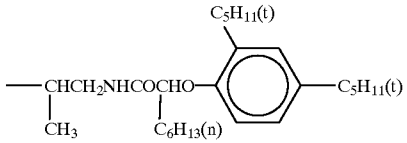 | The same as the above |
| M-16 | $CH_3$— | 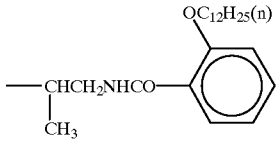 | Cl |

-continued
| Compound | $R_{10}$ | $R_{15}$ | $Y_4$ |
|---|---|---|---|
| M-17 | The same as the above | 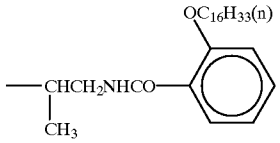 | The same as the above |
| M-18 | 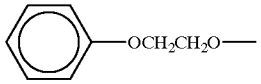 | 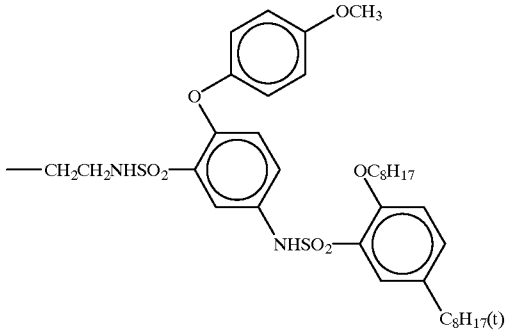 | 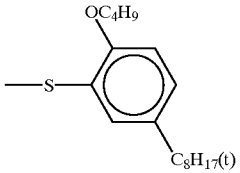 |
| M-19 | $CH_3CH_2O$— | The same as the above | The same as the above |
| M-20 | 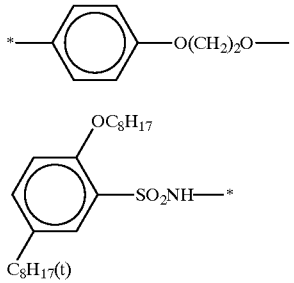 | 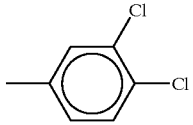 | 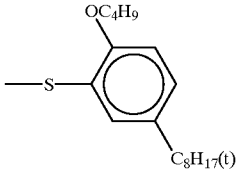 |
| M-21 | 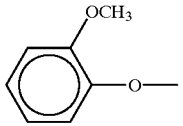 | 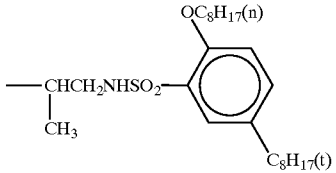 | Cl |

-continued
| Compound | $R_{10}$ | $R_{15}$ | $Y_4$ |
|---|---|---|---|
| | | 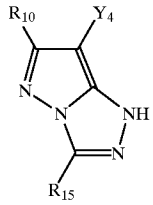 | |
| M-22 | $CH_3$— | 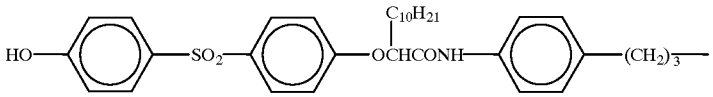 | Cl |
| M-23 | The same as the above | 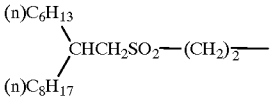 | The same as the above |
| M-24 | 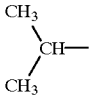 | 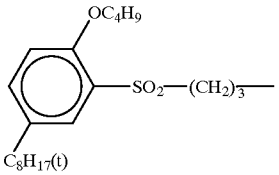 | The same as the above |
| M-25 | 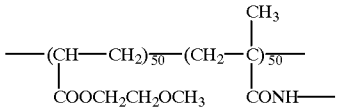 | 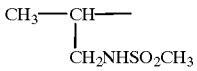 | The same as the above |
| M-26 | 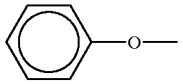 | 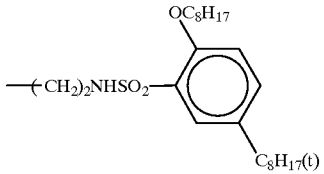 | Cl |

-continued
| Compound | $R_{10}$ | $R_{15}$ | $Y_4$ |
|---|---|---|---|
| M-27 | $CH_3$— | 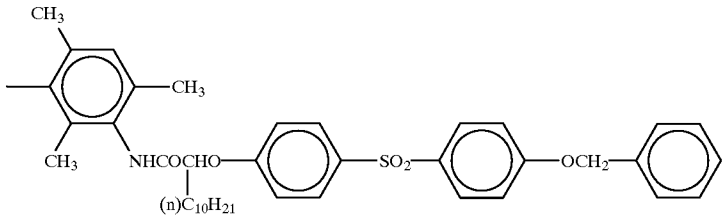 | The same as the above |
| M-28 | $(CH_3)_3C$— | 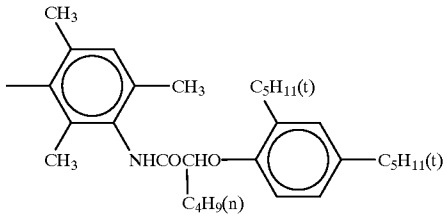 | The same as the above |
| M-29 | 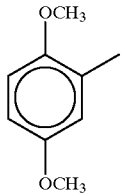 | 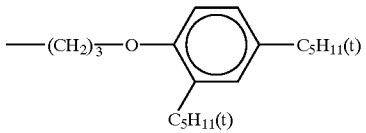 | Cl |
| M-30 | $CH_3$— | 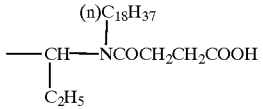 | The same as the above |

(Y-1)
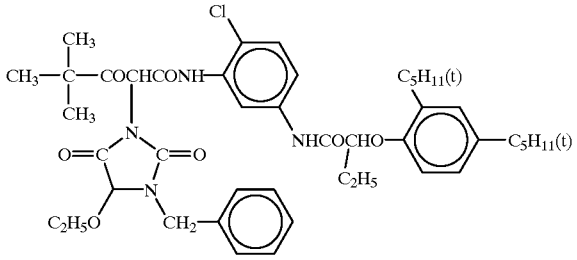
(Y-2)
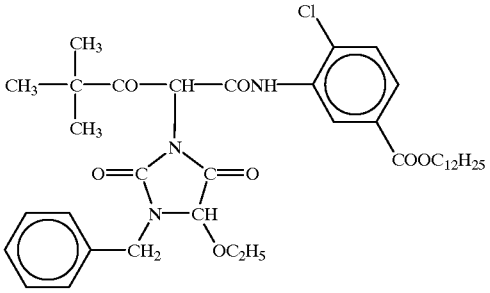
(Y-3)
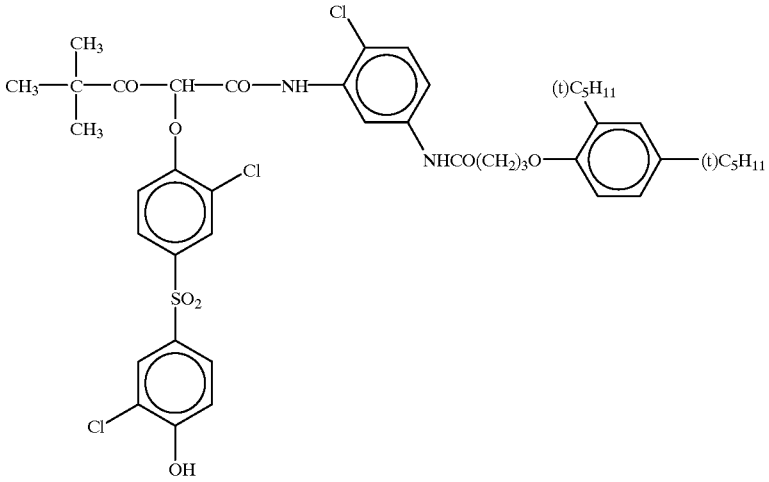
(Y-4)
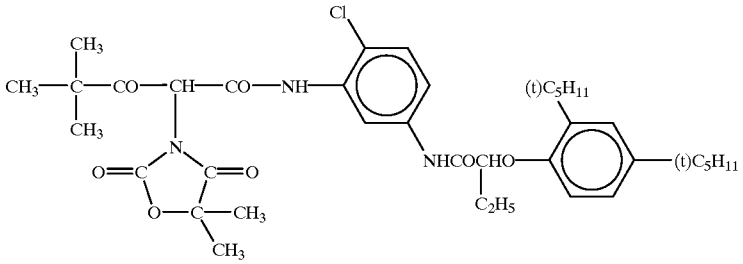
(Y-5)
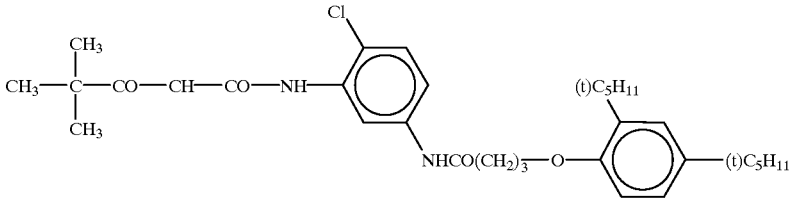

-continued (Y-6)

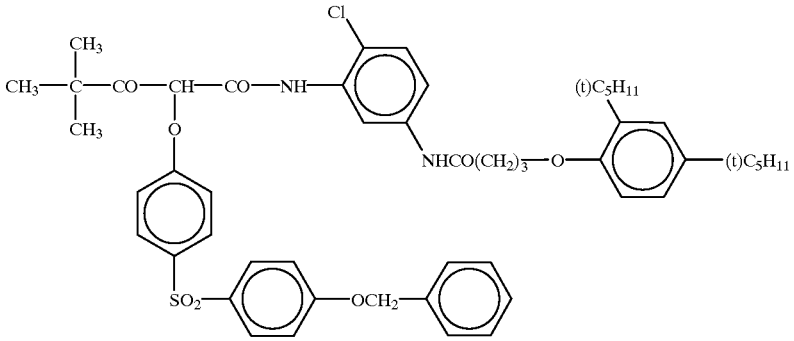

(Y-7)

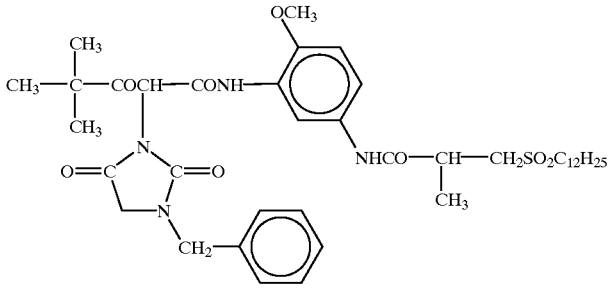

(Y-8)

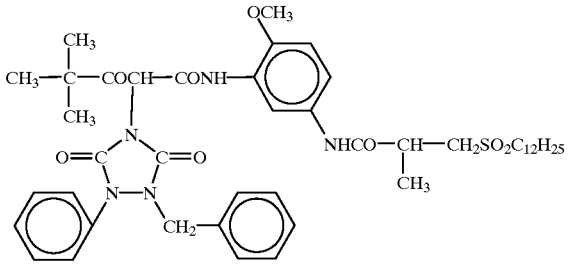

(Y-9)

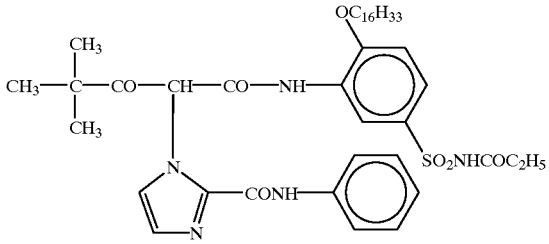

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A), (B), (C), (D), or (E) is preferably used.

Formula (A)

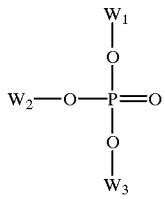

Formula (B)

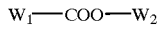

Formula (C)

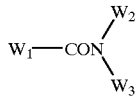

Formula (D)

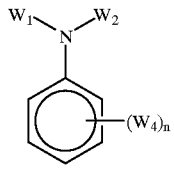

Formula (E)

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S–W_1$, n is an integer of 1 to 5, when n is 2 or over, $W_4$ groups may be the same or different, and in formula (E), $W_1$ and $W_2$ may together form a condensed ring.

As the high-boiling organic solvent used in the present invention, any compound other than compounds represented by formulae (A) to (E) can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in Japanese Patent Application No. 215272/1987, page 137 the right lower column to page 144 the right upper column.

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato) nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and Japanese Patent Application (OPI) No. 152225/1987; spiroindanes are described in U.S. Pat. No. 4,360,589; p-alkoxyphenols are described, for example, in U.S. Pat. No. 2,735,765, British Patent No. 2,066,975, Japanese Patent Application (OPI) No. 10539/1984, and Japanese Patent Publication No. 19765/1982; hindered phenols are described, for example, in U.S. Pat. Nos. 3,700,455, Japanese Patent Application (OPI) No. 72224/1977, U.S. Pat. No. 4,228,235, and Japanese Patent Publication No. 6623/1977; gallic acid derivatives, methylenedioxybenzenes, and aminophenols are described, for example, in U.S. Pat. Nos. 3,457,079 and 4,332,886, and Japanese Patent Publication No. 21144/1981 respectively; hindered amines are described, for example, in U.S. Pat. Nos. 3,336,135, 4,268,593, British Patent Nos. 1,326,889, 1,354,313, and 1,410,846, Japanese Patent Publication No. 1420/1976, and Japanese Patent Application (OPI) Nos. 114036/1983, 53846/1984, and 78344/1984; and metal complexes are described, for example, in U.S. Pat. Nos. 4,050,938 and 4,241,155 and British Patent No. 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in Japanese Patent Application (OPI) No. 2784/1971), cinnamic acid ester compounds (e.g., those described in U.S. Pat. Nos. 3,705,805 and 3,707,395), butadiene compounds (e.g., those described in U.S. Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

Together with the above couplers, the following compounds are preferably used. In particular, the combination use together with the pyrazoloazole coupler is preferable.

That is, it is preferred that a compound (F), which will chemically bond to the aromatic amine developing agent remaining after the color-developing process, to form a chemically inactive and substantially colorless compound, and/or a compound (G), which will chemically bond to the oxidized product of the aromatic amine color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine at the second-order reaction-specific rate $k_2$ (in trioctyl phosphate at 80° C.) in the range of 1.0 l/mol·sec to $1\times10^{-5}$ l/mol·sec. The second-order reaction- specific rate can be determined by the method described in Japanese Patent Application (OPI) No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII):

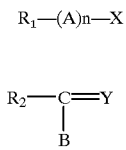

Formula (FI)

Formula (FII)

wherein $R_1$ and $R_2$ each represent an aliphatic group, an aromatic group, or a heterocyclic group, n is 1 or 0, A represents a group capable of reacting with an aromatic amine developing agent to form a chemical bond therewith, X represents a group capable of being released upon a reaction with the aromatic amine developing agent, B represents a hydrogen atom, an aliphatic group, an aromatic group, a heterocyclic group, an acyl group, or a sulfonyl group, Y represents a group that facilitates the addition of the aromatic amine developing agent to the compound represented by formula (FII), and $R_1$ and X, or Y and $R_2$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in Japanese Patent Application (OPI) Nos. 158545/1988 and 28338/1987, European Published Patent No.s 298321 and 277589.

On the other hand, more preferable examples of compound (G), which will chemically bond to the oxidized product of the aromatic amine developing agent remaining after color development processing, to form a chemically inactive and colorless compound, can be represented by the following formula (GI):

R—Z Formula (GI)

wherein R represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^{n}CH_3I$ value (R. G. Pearson, et al., J. Am. Chem. Soc., 90, 319 (1968)) is 5 or over, or a group derived therefrom.

Specific examples of compounds represented by formula (GI) are described, for example, in European Published Patent No. 255722, Japanese Patent Application (OPI) Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

As a binder or a protective colloid that can be used in the emulsion layers of the present photographic material, gelatin is advantageously used, but other hydrophilic colloids can be used alone or in combination with gelatin.

In the present invention, gelatin may be lime-processed gelatin or acid-processed gelatin. Details of the manufacture of gelatin is described by Arthur Veis in The Macromolecular Chemistry of Gelatin (published by Academic Press, 1964).

The degree of swelling [(the swollen film thickness equilibrated in $H_2O$ at 25° C.—the dried overall film thickness at 25° C. and 55% RH/the dried overall film thickness at 25° C. and 55% RH)×100] of the photographic material of the present invention is preferably 50 to 200%, more preferably 70 to 150%. If the degree of swelling is outside the above value, the photographic propertiesare susceptible to change.

The swelling speed $T_{1/2}$ of the photographic material of the present invention (the swelling speed $T_{1/2}$ being defined as ½ of the time when the swell of the photographic material in the color developer at 38° C. reaches 90% of the saturated swollen film thickness) is preferably 15 sec or less, more preferably 9 sec or less.

Further, to the photographic material of the present invention, various dyes can be added.

These dyes may be used alone or in combination. There is no particular restriction on the layer to which these dyes are added, and they can be added, for example, to the layer between the lowermost photosensitive layer and the base, a photosensitive layer, an intermediate layer, a protective layer, and the layer between the protective layer and the uppermost photosensitive layer.

As the method for adding these dyes, conventional methods can be used, and for example the dyes may be added by first dissolving them in water or an alcohol, such as methanol.

For the amount of the dyes to be added, the following coating amounts can be used as guidelines.

Cyan dyes: 20 to 100 mg/m$^2$ (the most preferable amount)
Magenta dyes: 0 to 50 mg/m$^2$ (preferable amount)
0 to 10 mg/m$^2$ (the most preferable amount)
Yellow dyes: 0 to 30 mg/m$^2$ (preferable amount)
5 to 20 mg/m$^2$ (the most preferable amount)

When the dyes to be added to the layers are caused to be present in the dispersed state in all the layers in the course from application of the photographic material to the drying thereof, the effect of the present invention is made more remarkable than when they are fixed in specific layers, and the former case is preferable in view of the prevention of an increase of the production cost due to putting the dyes in specific layers.

Dyes that can be used in the present invention are, for example, oxonol dyes having a pyrazolone nucleus or barbituric acid nucleus described, for example, in British Patent Nos. 506,385, 1,177,429, 1,311,884, 1,338,799, 1,385,371, 1,467,214, 1,433,102, and 1,553,516, Japanese Patent Application (OPI) Nos. 85130/1973, 114420/1974, 117123/1977, 161233/1980, and 111640/1984, Japanese Patent Publication Nos. 22069/1964, 13168/1968, and 273527/1987, and U.S. Pat. Nos. 3,247,127, 3,469,985, and 4,078,933; other oxonol dyes described, for example, in U.S. Pat. Nos. 2,533,472 and 3,379,533 and British Patent No. 1,278,621; azo dyes described, for example, in British Patent Nos. 575,691, 680,631, 599,623, 786,907, 907,125, and 1,045,609, U.S. Pat. No. 4,255,326, and Japanese Patent Application (OPI) No. 211043/1984; azomethine dyes described, for example, in Japanese Patent Application (OPI) Nos. 100116/1975 and 118247/1979 and British Patent Nos. 2,014,598 and 750,031; anthraquinone dyes described in U.S. Pat. No. 2,865,752; arylidene dyes described, for example, in U.S. Pat. Nos. 2,538,009, 2,688,541, and 2,538,008, British Patent Nos. 584,609 and 1,210,252, Japanese Patent Application (OPI) Nos. 40625/1975, 3623/1976, 10927/1976 and 118247/1989, and Japanese Patent Publication Nos. 3286/1973 and 37303/1984; styryl dyes described, for example, in Japanese Patent Publication Nos. 3082/1953, 16594/1969, and 28898/1984; triarylmethane dyes described, for example, in British Patent Nos. 446,583 and 1,335,422 and Japanese Patent Application (OPI) No. 228250/1964; merocyanine dyes described, for example, in British Patent Nos. 1,075,653, 1,153,341, 1,284,730, 1,475,228; and 1,542,807, and cyanine dyes described, for example, in U.S. Pat. Nos. 2,843,846 and 3,294,539.

Among these dyes, those that can be used particularly preferably in the present invention are dyes represented by the following formula (I), (II), (III), (IV), (V), or (VI):

Formula (I)

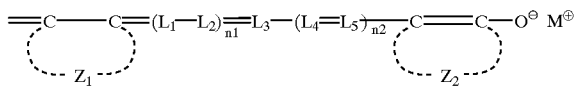

wherein $Z_1$ and $Z_2$, which may be the same or different, each represent a group of nonmetal atoms required to form a heterocyclic ring, $L_1$, $L_2$, $L_3$, $L_4$, and $L_5$ each represent a methine group, $n_1$ and $n_2$ each is 0 or 1, and $M^{\oplus}$ represents hydrogen or other monovalent cations.

Formula (II)

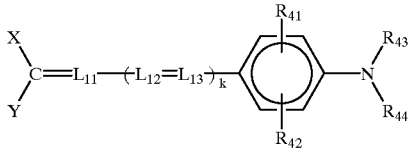

In formula (II), X and Y, which may be the same or different, each represent an electron-attractive group, or X and Y may bond together to form a ring.

$R_{41}$ and $R_{42}$, which may be the same or different, each represent a hydrogen atom, a halogen atom, an alkyl group, an alkoxy group, a hydroxy group, a carboxyl group, a substituted amino group, a carbamoyl group, a sulfamoyl group, an alkoxycarbonyl group, or a sulfo group.

$R_{43}$ and $R_{44}$, which may be the same or different, each represent a hydrogen atom, an alkyl group, an alkenyl group, an aryl group, an acyl group, or a sulfonyl group, or $R_{43}$ and $R_{44}$ may bond together to form a 5- to 6-membered ring. $R_{41}$ and $R_{43}$ may bond together to form a 5- to 6- membered ring, and $R_{42}$ and $R_{44}$ may bond together to form a p 5- to 6-membered ring.

At least one of X, Y, $R_{41}$, $R_{42}$, $R_{43}$, and $R_{44}$ has a sulfo group or a carboxyl group as a substituent.

$L_{11}$, $L_{12}$, and $L_{13}$ each represent a methine group. k is 0 or 1.

$Ar_1—N=N—Ar_2$ Formula (III)

wherein $Ar_1$ and $Ar_2$, which may be the same or different, each represent an aryl group or a heterocyclic group.

Formula (IV)

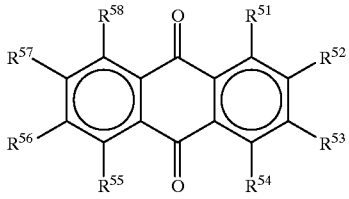

wherein $R^{51}$, $R^{54}$, $R^{55}$, and $R^{58}$, which may be the same or different, each represent a hydrogen atom, a hydroxy group, an alkoxy group, an aryloxy group, a carbamoyl group, and an amino group

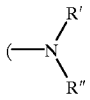

in which R' and R", which may be the same or different, each represent a hydrogen atom, an aryl group, or an alkyl group, having at least one sulfonic acid group or a carboxyl group).

$R^{52}$, $R^{53}$, $R^{56}$, and $R^{57}$, which may be the same or different, each represent a hydrogen atom, a sulfonic acid group, a carboxyl group, or an alkyl group or aryl group, having at least one sulfonic acid group or a carboxyl group.

Formula (V)

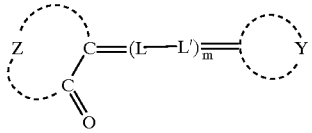

wherein L and L' each represent a substituted or unsubstituted methine group or a nitrogen atom, and m is 0, 1, 2, or 3.

Z represents a group of nonmetal atoms required to form a pyrazolone nucleus, a hydroxypyridone nucleus, a barbituric acid nucleus, a thiobarbituric acid nucleus, a dimedone nucleus, an indane-1,3-dione nucleus, a rhodanine nucleus, a thiohydantoin nucleus, an oxazolidine-4-one-2-thione nucleus, a homophthalimido nucleus, a pyrimidine-2,4-dione nucleus, or a 1,2,3,4-tetrahydroquinoline-2,4-dione nucleus.

Y represents a group required to form an oxazole nucleus, a benzoxazole nucleus, a naphthoxazole nucleus, a thiazole nucleus, a benzothiazole nucleus, a nathothiazole nucleus, a benzoselenazole nucleus, a pyridine nucleus, a quinoline nucleus, a benzoimidazole nucleus, a naphthoimidazole nucleus, an imidazoquinoxaline nucleus, an inodolenine nucleus, an isooxazole nucleus, a benzoisooxazole nucleus, a naphthoisooxazole nucleus, or an acridine nucleus, and Z and Y may be substituted.

Formula (VI)

(A)

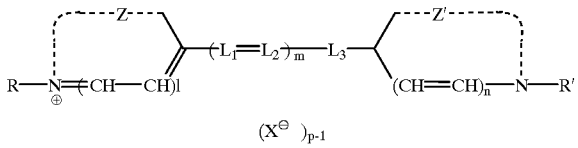

or (B)

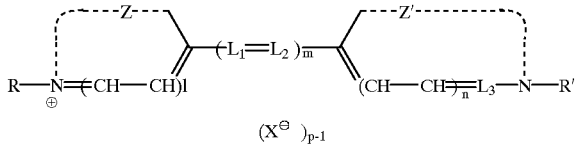

wherein R and R', which may be the same or different, each represent a substituted or unsubstituted alkyl group.

$L_1$, $L_2$, and $L_3$, which may be the same or different, each represent a substituted or unsubstituted methine group, and m is 0, 1, 2, or 3.

Z and Z', which may be the same or different, each represent a group of nonmetal atoms required to form a substituted or unsubstituted heterocyclic 5- or 6-membered ring, and l and n each are 0 or 1.

$X^{\ominus}$ represents an anion, p is 1 or 2, and when the compound forms an inner salt, p is 1.

Of the dyes represented by formula (I), particularly preferable ones are dyes represented by the following formula (I-a):

Formula (I-a)

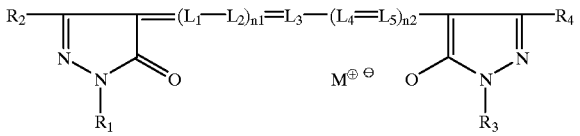

wherein $R_1$ and $R_3$ each represent an aliphatic group, an aromatic group, or a heterocyclic group, $R_2$ and $R_4$ each represent an aliphatic group, an aromatic group, —$OR_5$, —$COOR_5$, O—$NR_5R_6$, —$CONR_5R_6$, —$NR_5CONR_5R_6$, —$SO_2R_7$, —$COR_7$, —$NR_6COR_7$, —$NR_6SO_2R_7$, or a cyano group (in which $R_5$ and $R_6$ each represent a hydrogen atom, an aliphatic group, or an aromatic group, $R_7$ represents an aliphatic group or an aromatic group, and $R_5$ and $R_6$, or $R_6$ and $R_7$, may bond together to form a 5- or 6-membered ring), and $L_1$, $L_2$, $L_3$, $L_4$, $L_5$, $n_1$, $n_2$, and $M^{\oplus}$ have the same meanings as defined in formula (I).

Examples of the dyes represented by formula (I-a) are shown below, but the present invention is not restricted to them.

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-1 | 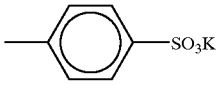 | —$CH_3$ | =CH— | H |
| a-2 | 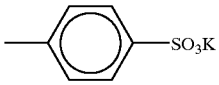 | —$CONHC_3H_7^{(n)}$ | =CH— | H |
| a-3 | 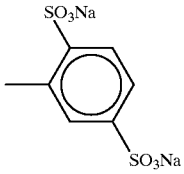 | —OH | =CH—CH=CH— | Na |
| a-4 | 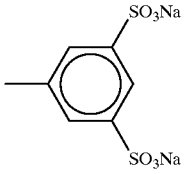 | —$OC_2H_5$ | =CH—(CH=CH)$_2$ | Na |
| a-5 | —$CH_2CH_2SO_3K$ | —$COOC_2H_5$ | =CH—CH=CH— | H |
| a-6 | 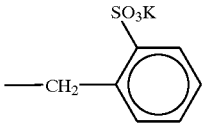 | —$CONHC_4H_9^{(n)}$ | =CH—CH=CH— | H |
| a-7 | —$CH_2CH_2SO_3K$ | —COOK | =CH-(CH=CH)$_2$ | H |
| a-8 | 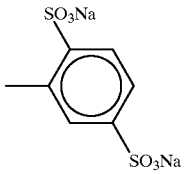 | —$COCH_3$ | =CH-(CH=CH)$_2$ | Na |
| a-9 | 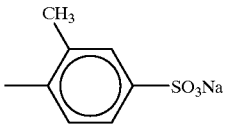 | —$CF_3$ | =CH—(CH=CH)$_2$ | H |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-10 | 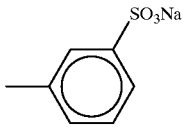 | $-NHCOCH_3$ | $=CH-CH=CH-$ | H |
| a-11 | 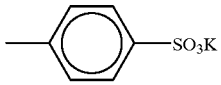 | $-COOC_2H_5$ | $=CH-(CH=CH)_2$ | H |
| a-12 | 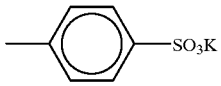 | $-COOK$ | $=CH-CH=CH-$ | H |
| a-13 | 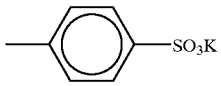 | $-NHCONHCH_3$ | $=CH-CH=CH-$ | H |
| a-14 | $-(CH_2)_4SO_3K$ | $-OH$ | $=CH-$ | H |
| a-15 | 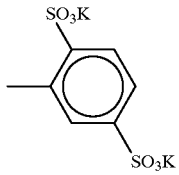 | $-COOK$ | $=CH-CH=CH-$ | K |
| a-16 | 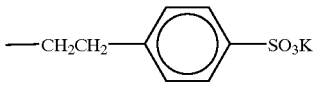 | $-C_4H_5$ | $=CH-CH=CH-$ | H |
| a-17 | 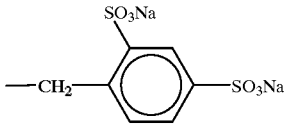 | $-COOC_2H_5$ | $=CH-(CH=CH)_2$ | Na |
| a-18 | 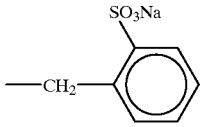 | $-CONHCH_2CH_2OH$ | $=CH-(CH=CH)_2$ | H |
| a-19 | 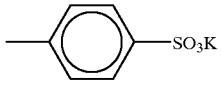 | $-CONHCH_2CH_2SO_3K$ | $=CH-(CH=CH)_2$ | H |
| a-20 | $-(CH_2)_3SO_3K$ | $-CONHC_7H_{15}{}^{(n)}$ | $=CH-CH=CH-$ | H |
| a-21 | $-CH_2COOK$ | $-COOK$ | $=CH-CH=CH-$ | K |
| a-22 | $-CH_2CH_2SO_3K$ | $-N(CH_3)_2$ | $=CH-(CH=CH)_2$ | H |
| a-23 | $-(CH_2)_3SO_3K$ | $-CN$ | $=CH-(CH=CH)_2$ | H |
| a-24 | 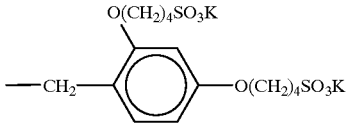 | $-CH_2Cl$ | $=CH-(CH=CH)_2$ | H |
| a-25 | $-(CH_2)_2SO_3Na$ | $-OH$ | $=CH-(CH=CH)_2$ | H |

-continued
| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-26 | 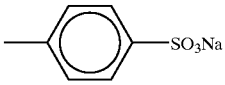 | $-CH_3$ | 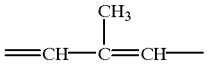 | Na |
| a-27 | 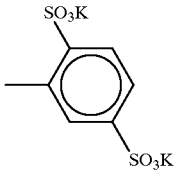 | $-COOC_2H_5$ | $=CH-(CH=CH)_2$ | H |
| a-28 | 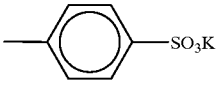 | $-CONHC_2H_5$ | $=CH-CH=CH-$ | H |
| a-29 | 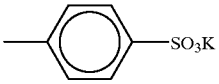 | $-NHCOC_3H_7^{(i)}$ | $=CH-CH=CH-$ | H |
| a-30 | $-CH_2CH_2SO_3K$ | 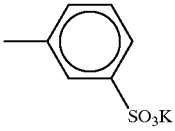 | $=CH-CH=CH-$ | H |
| a-31 | 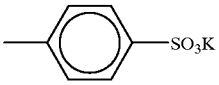 | $-CH_3$ | 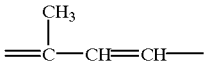 | H |
| a-32 | 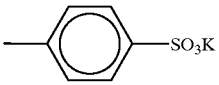 | $-C_4H_9$ | $=CH-CH=CH-$ | H |
| a-33 | 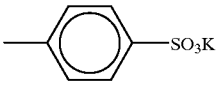 | $-CN$ | $=CH-(CH=CH)_2$ | H |
| a-34 | 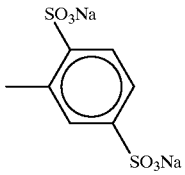 | $-COCH_3$ | 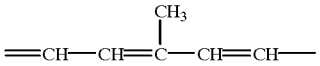 | Na |
| a-35 | 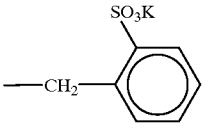 | $-COOK$ | $=CH-(CH=CH)_2$ | H |
| a-36 | 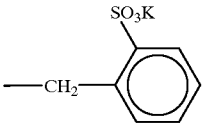 | $-COOK$ | $=CH-CH=CH-$ | H |

-continued

| No. | $R_1$, $R_3$ | $R_2$, $R_4$ | $=(L_1-L_2)_{n1}=L_3-(L_4=L_5)_{n2}-$ | $M^{\oplus}$ |
|---|---|---|---|---|
| a-37 | 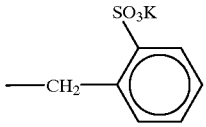 | $-CONHC_4H_9$ (I) | $=CH-(CH=CH)_2$ | H |
| a-38 | 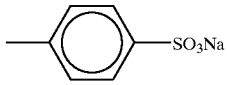 | $-NHSO_2CH_3$ | $=CH-(CH=CH)_2$ | H |
| a-39 | 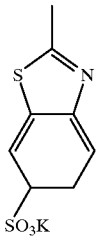 | $-CN$ | $=CH-(CH=CH)_2$ | H |
| a-40 | 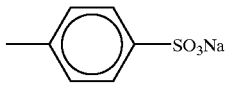 | $-OC_2H_5$ | $=CH-(CH=CH)_2$ | H |
| a-41 | 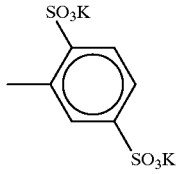 | $-CN$ | $=CH-(CH=CH)_2$ | H |

As dyes represented by formulae (I) to (VI) to be used in the present invention can be used those described in the specification of Japanese Patent Application (OPI) No. 297213/1988, pp. 27 to 103.

Dyes to be used in the present invention dissolve out from the silver halide photographic material in any step from development to water-washing steps, or are discolored by sulfite salts, as described in British Patent No. 506,385.

PREFERRED EMBODIMENTS OF THE INVENTION

Next, Examples of the present invention will be described below, but the invention is not limited to these Examples.

EXAMPLE 1

(Preparation of Support)

100% of LBKP (hardwood bleached sulfate pulp) for photographic printing paper (basis weight 175 g/m$^2$, thickness about 180$\mu$); resin layer that contains white pigment comprising water-proof anatase-type titanium oxide of the following composition is provided on the surface of a white paper to obtain a support shown below.

Support 10 wt.pts of white pigment, anatase-type titanium oxide, whose particle surface was treated as shown below, was added to 90 wt.pts of a polyethylene composition (density: 0.920 g/cc; melt index (MI): 5.0 g/10 min), then they were kneaded and a water-resistant resin layer having a thickness of 30 $\mu$m was obtained by melt extrusion coating.

Titanium oxide powder was immersed in an ethanol solution of 2,4-dihydroxy-2-methylpentane and the mixture was heated to evaporate the ethanol, to obtain titanium oxide white pigment whose particle surface had been treated. The alcohol coated the particle surface in an amount of about 1 wt % based on the titanium oxide. The water-resistant resin layer comprising the polyethylene composition was provided on the undersurface of white raw paper.

The thus-prepared reflective bases were subjected to corona discharge treatment and a gelatin undercoat was provided. Layers shown below were applied to this base to prepare multilayer color print paper. The coating solutions were prepared as shown below. Preparation of a First Layer Coating Solution To a mixture of 19.1 g of yellow coupler (Exy), 4.4 g of image-dye stabilizer (Cpd-1), and 0.7 g of image-dye stabilizer (Cpd-7), 27.2 cc of ethyl acetate and 8.2 g of solvent (Solv-1) were added and dissolved. The resulting solution was dispersed and emulsified in 185 cc of 10% aqueous gelatin solution containing 8 cc of sodium dodecylbenbenesulfonate. Separately, a silver chlorobromide emulsion (Emulsion 1, the method of preparation will be described hereinafter) was prepared by being subjected to a sulfur-sensitization after blue-sensitive sensitizing dyes shown below were added.

The above-described emulsified dispersion and this emulsion were mixed together and dissolved to give the composition shown below, thereby preparing the first layer coating solution. Coating solutions for the second to seventh layers were prepared in a manner similar to that for the first coating solution.

As the gelatin hardener for each layer, 1-oxy-3,5-dichloro-s-triazine sodium salt was used. Hexachloroiridium (IV) potassium was added to each emulsion during the formation of emulsion. The amount added was same to large size emulsion and small size emulsion, and in an amount of $1\times10^{-7}$ mol for blue-sensitive layer, $3\times10^{-7}$ mol for green-sensitive layer, and $5\times10^{-7}$ mol, per mol of silver.

As spectral sensitizing dye for each layer the followings were used to be CR compound during the formation of localized phase.

Blue-sensitive Emulsion Layer (S-1)

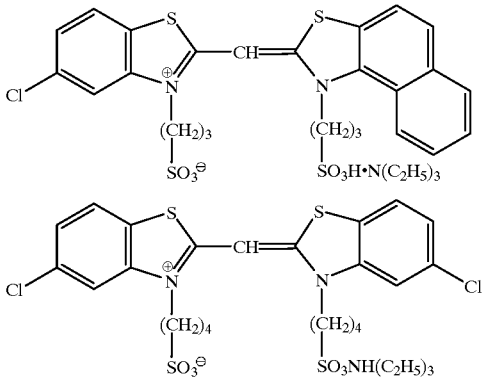

(each $2.0\times10^{-4}$ mol to the large size emulsion, per mol of silver halide)

Green-sensitive Emulsion Layer (S-2)

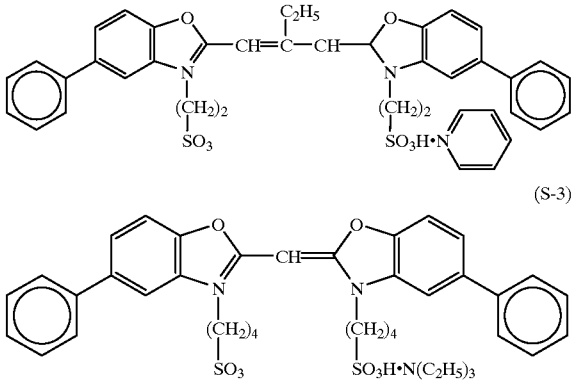

(S-3)

Red-sensitive Emulsion Layer (S-4)

I

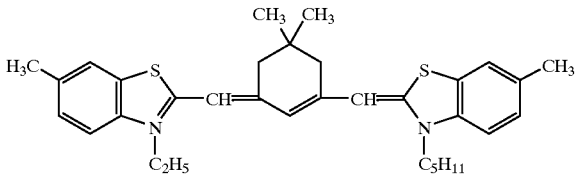

To the red-sensitive emulsion layer, the following compound was added in an amount of $2.6\times10^{-3}$ mol per mol of silver halide:

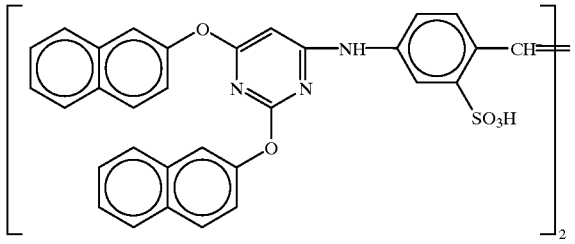

Further, 1-(5-methylureidophenyl)-5-mercaptotetrazole was added to the blue-sensitive emulsion layer, the green-sensitive emulsion layer, and the red-sensitive emulsion layer in amount of $8.5\times10^{-5}$ mol, $7.7\times10^{-4}$ mol, and $2.5\times10^{-4}$ mol, per mol of silver halide, respectively.

Further, 4-hydroxy-6-methyl-1,3,3a,7-tetrazaindene was added to the blue-sensitive emulsion later and green-sensitive emulsion layer in an amount of $1\times10^{-4}$ mol and $2\times10^{-4}$ mol, per mol of silver halide, respectively.

The dyes shown below were added to the emulsion layers for prevention of irradiation:

Blue-sensitive Emulsion Layer (Yellow Dye)

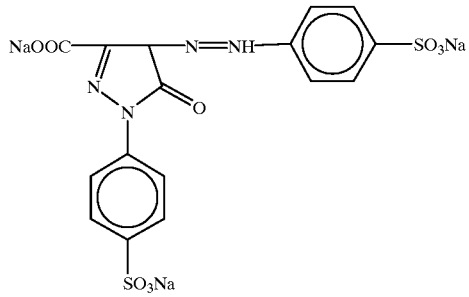

7. 1mg/m$^2$ and

Green-sensitive Emulsion Layer (Magenta Dye)

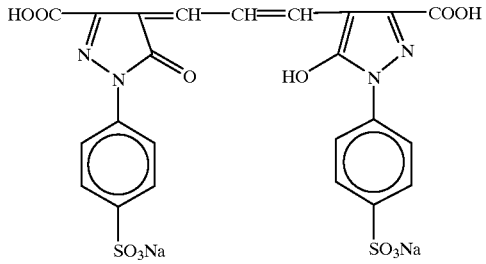

5. 0mg/m$^2$

Cyan Dye I

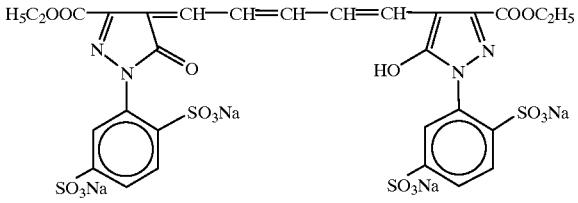

and

Cyan Dye II

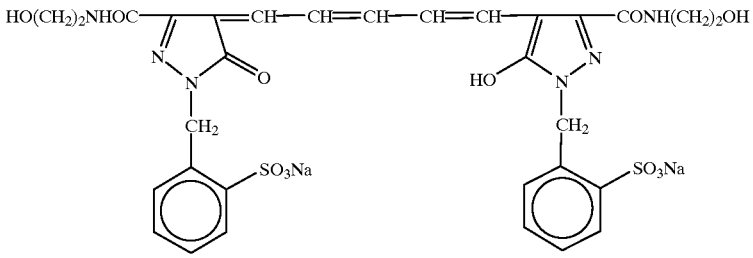

* Ratio: 5 to 2 (in weight ratio)

Further, the following compounds were used as antiseptics (each figure represents a coating amount).

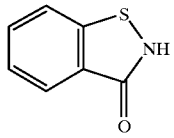

(25. 0mg/m$^2$)

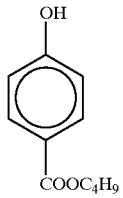

(50. 0mg/m$^2$)

Blue-sensitive Emulsion B-1 (in the Case of Sample 1 in Table 1)

| | |
|---|---|
| (1 Solution) | |
| $H_2O$ | 1000 cc |
| NaCl | 5.5 g |
| Gelatin | 32 g |
| (2 Solution) | |
| Sulfuric acid (1N) | 24 cc |
| (3 Solution) | |
| Compound A shown below (1%) | 3 cc |

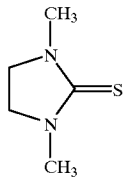

| | |
|---|---|
| (4 Solution) | |
| NaCl | 1.7 g |
| $H_2O$ to make | 200 cc |
| (5 Solution) | |
| $AgNO_3$ | 5 g |
| $H_2O$ to make | 200 cc |
| (6 Solution) | |
| NaCl | 41.3 g |
| $K_2IrCl_6$ (0.001%) | 0.5 cc |
| $H_2O$ to make | 600 cc |
| (7 Solution) | |
| $AgNO_3$ | 120 g |
| $H_2O$ to make | 600 cc |

The (1 Solution) was heated to 76° C., and then (2 Solution) and (3 Solution) were added. Then (4 Solution) and (5 Solution) were added simultaneously over 10 minutes. After more 10 minutes, (6 Solution) and (7 Solution) were added simultaneously over 10 minutes. After 5 minutes, the temperature was lowered, and desilvering was conducted. Water and dispersed gelatin were added, and pH was adjusted to 6.3, to obtain cubic shape silver chloride emulsion having an average grain size of 1.1 $\mu$m and a deviation coefficient (standard deviation divided by average grain size: s/d) of 0.30.

To 1.0 kg of this emulsion 26 cc of 0.6% solution of spectral sensitizing dye for blue (S-1) was added, further AgBr ultra fine particles of 0.05$\mu$ was added in a ratio of 0.5 mol % to host AgCl emulsion, and mixed and ripened at 58° C. for 10 minutes. Then, sodium thiosulfite was added to perform chemical sensitization optimumly, and stabilizer (Stb-1) was added in an amount of $10^{-4}$ mol/mol Ag.

Next, emulsions that have different deviation coefficients were prepared by elongation of addition time of (6 Solution) and (7 Solution), to obtain emulsions B-2 (25%), B-3 (20%), B-4 (15%), and B-5 (10%).

Green-sensitive Emulsion G-1 (in the Case of Sample 1 in Table 1)

TABLE 1

| | |
|---|---|
| (8 Solution) | |
| $H_2O$ | 1000 ml |
| NaCl | 3.3 g |
| Gelatin | 32 g |
| (9 Solution) | |
| Sulfuric acid (1N) | 24 ml |
| (10 Solution) | |
| Compound A (1%) | 3 ml |
| (11 Solution) | |
| NaCl | 11.00 g |
| $H_2O$ to make | 200 ml |
| (12 Solution) | |
| $AgNO_3$ | 32.00 g |
| $H_2O$ to make | 200 ml |
| (13 Solution) | |
| NaCl | 44.00 g |
| $K_2IrCl_6$ (0.001%) | 2.3 ml |
| $H_2O$ to make | 560 ml |
| (14 Solution) | |
| $AgNO_3$ | 128 g |
| $H_2O$ to make | 560 ml |

The (8 Solution) was heated to 52° C., and then (9 Solution) and (10 Solution) were added. Then (11 Solution) and (12 Solution) were added simultaneously over 8 minutes. After more 10 minutes, (13 Solution) and (14 Solution) were added simultaneously over 15 minutes.

To this emulsion added sensitizing dyes (S-2) in an amount of $4\times10^{-4}$ mol and (S-3) in an amount of $8\times10^{-5}$ mol, per mol of silver halide, then (15 Solution) shown below was added over 10 minutes, and, after 5 minutes, the temperature was lowered and desilvering was conducted.

| (15 Solution) | |
|---|---|
| KBr | 5.60 g |
| $H_2O$ to make | 280 ml |

Water and dispersed gelatin were added, and pH was adjusted to 6.2, sodium thiosulfate was added at 58° C. to perform chemical sensitization optimumly, to obtain a monodisperse cubic shape silver chloride emulsion having an average grain size of 0.48 $\mu$m and a deviation coefficient (standard deviation divided by average grain size: s/d) of 0.30.

Next, emulsions that have different deviation coefficients were prepared by elongation of addition time of (11 Solution) and (12 Solution), and (13 Solution) and (14 Solution), to obtain emulsions G-2 (25%), G-3 (20%), G-4 (15%), and G-5 (10%).

Red-sensitive emulsions were prepared in the same manner as green-sensitive emulsions, except that the sensitizing dye for use was changed to (S-4), and the amount added was changed to $1.5\times10^{-4}$ mol per mol of silver halide.

| | Deviation coefficient |
|---|---|
| R-1 | 30% |
| R-2 | 25% |
| R-3 | 20% |
| R-4 | 15% |
| R-5 | 10% |

(Composition of Layers)

The composition of each layer is shown below. The figures represent coating amounts (g/m$^2$). The coating amounts of each silver halide emulsion is represented in terms of silver.

First Layer (Blue-sensitive Emulsion Layer)

| | |
|---|---|
| The above-described silver chlorobromide emulsion | 0.30 |
| Gelatin | 1.86 |
| Yellow coupler (ExY) | 0.82 |
| Image-dye stabilizer (Cpd-1) | 0.19 |
| Solvent (Solv-1) | 0.35 |
| Image-dye stabilizer (Cpd-7) | 0.06 |

Second Layer (Color-mix Preventing Layer)

| | |
|---|---|
| Gelatin | 0.99 |
| Color mix inhibitor (Cpd-5) | 0.08 |
| Solvent (Solv-1) | 0.16 |
| Solvent (Solv-4) | 0.08 |

Third Layer (Green-sensitive Emulsion Layer)

| | |
|---|---|
| Silver chlorobromide emulsion | 0.20 |
| Gelatin | 1.24 |
| Magenta coupler (ExM) | 0.20 |
| Image-dye stabilizer (Cpd-2) | 0.03 |
| Image-dye stabilizer (Cpd-3) | 0.15 |
| Image-dye stabilizer (Cpd-4) | 0.02 |
| Image-dye stabilizer (Cpd-9) | 0.02 |
| Solvent (Solv-2) | 0.40 |

Fourth Layer (Ultraviolet Rays Absorbing Layer)

| | |
|---|---|
| Gelatin | 1.58 |
| Ultraviolet absorber (UV-1) | 0.47 |
| Color-mix inhibitor (Cpd-5) | 0.05 |
| Solvent (Solv-5) | 0.24 |

Fifth Layer (Red-sensitive Emulsion Layer)

| | |
|---|---|
| Silver chlorobromide emulsion | 0.20 |
| Gelatin | 1.34 |
| Cyan coupler (ExC) | 0.32 |
| Image-dye stabilizer (Cpd-6) | 0.17 |
| Image-dye stabilizer (Cpd-7) | 0.40 |
| Image-dye stabilizer (Cpd-8) | 0.04 |
| Solvent (Solv-6) | 0.15 |

Sixth Layer (Ultraviolet Rays Absorbing Layer)

| | |
|---|---|
| Gelatin | 0.53 |
| Ultraviolet absorber (UV-1) | 0.16 |
| Color-mix inhibitor (Cpd-5) | 0.02 |
| Solvent (Solv-5) | 0.08 |

Seventh Layer (Protective Layer)

| | |
|---|---|
| Gelatin | 1.33 |
| Acryl-modified copolymer of polyvinyl alcohol (modification degree: 17%) | 0.17 |
| Liquid paraffin | 0.03 |

(ExY) Yellow Coupler

Mixture (1:1 in molar ratio) of

R =

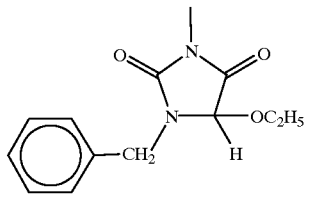

and

-continued
R =
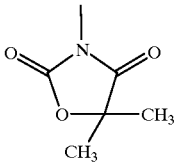
and
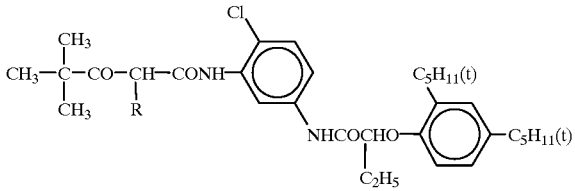
(ExM) Magenta Coupler
Mixture (1:1 in molar ratio) of
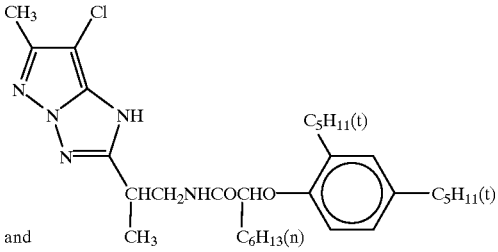
and
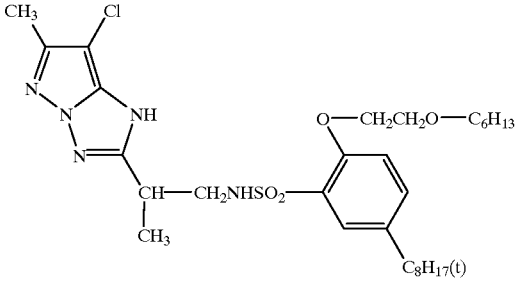
(ExC) Cyan Coupler
Mixture (2:4:4 in weight ratio) of R═$C_2H_5$ and $C_4H_9$ of
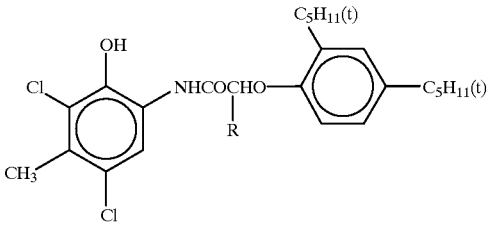
and
-continued
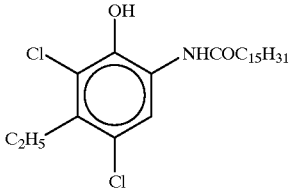
(Cpd-1) Image-dye Stabilizer
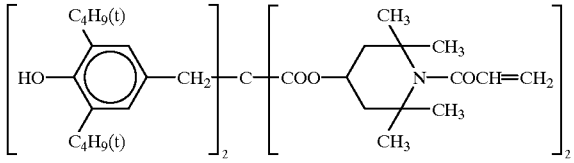
(Cpd-2) Image-dye Stabilizer
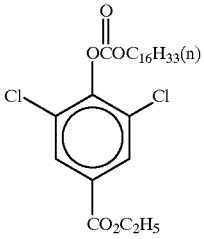
(Cpd-3) Image-dye Stabilizer
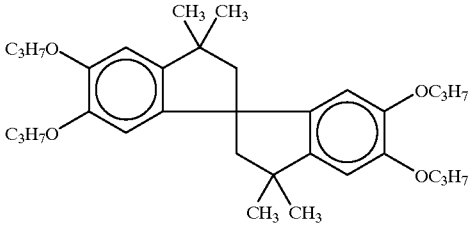
(Cpd-4) Image-dye Stabilizer
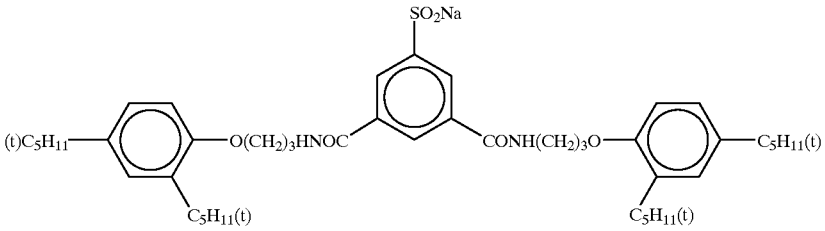

(Cpd-5) Color-mix Inhibitor
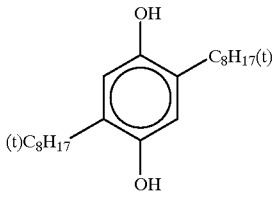
(Cpd-6) Image-dye Stabilizer
Mixture (2:4:4 in weight ratio) of
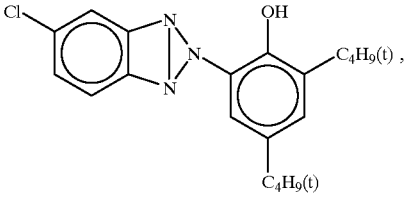
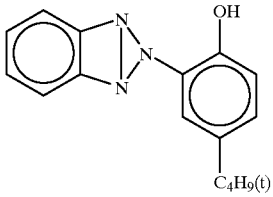
and
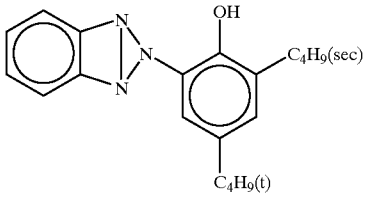
(Cpd-7) Image-dye Stabilizer
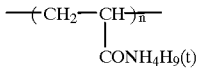
(Cpd-8) Image-dye Stabilizer
Mixture (1:1) of
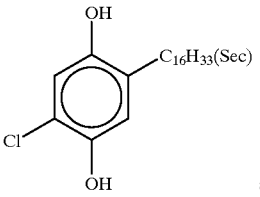
and
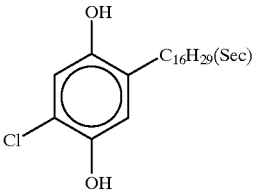
(Cpd-9) Image-dye Stabilizer
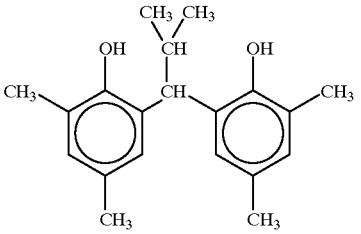
(UV-1) Ultraviolet Ray Absorber
Mixture (4:2:4 in weight ratio) of
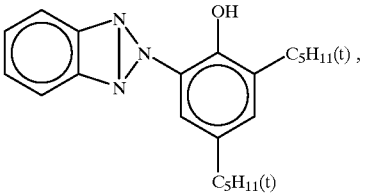
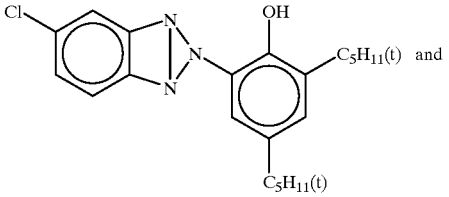
and
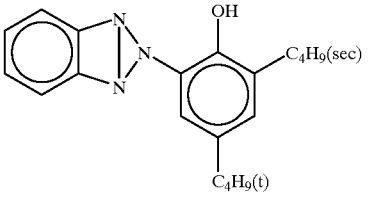
(Solv-1) Solvent
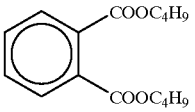
(Solv-2) Solvent
Mixture (2:1 in volume ratio) of
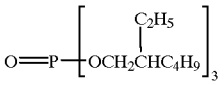
and
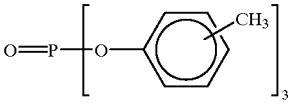

(Solv-4) Solvent

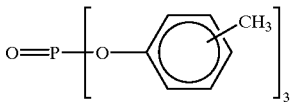

(Solv-5) Solvent

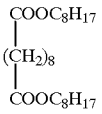

(Solv-6) Solvent
Mixture (95:5) of

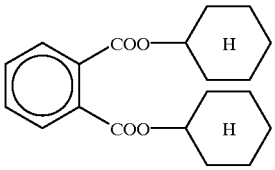

and

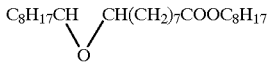

Emulsions used in respective layers are as in the following Table 1.

TABLE 1

| | Sample 1 | Sample 2 | Sample 3 | Sample 4 | Sample 5 |
|---|---|---|---|---|---|
| Blue-sensitive emulsion layer | | | | | |
| Emulsion | B-1 | B-2 | B-3 | B-4 | B-5 |
| Deviation coefficient | 30% | 25% | 20% | 15% | 10% |
| Average grain size | 1.1μ | 1.1μ | 1.2μ | 1.2μ | 1.2μ |
| Shape of grain | cubic | cubic | cubic | cubic | cubic |
| Halogen composition C1% | 98.5 | 98.6 | 98.8 | 99.0 | 99.0 |
| Green-sensitive emulsion layer | | | | | |
| Emulsion | G-1 | G-2 | G-3 | G-4 | G-5 |
| Deviation coefficient | 30% | 25% | 20% | 15% | 10% |
| Average grain size | 0.47μ | 0.48μ | 0.49μ | 0.49μ | 0.49μ |
| Shape of grain | cubic | cubic | cubic | cubic | cubic |
| Halogen composition C1% | 99.5 | 99.6 | 99.6 | 99.7 | 99.8 |
| Red-sensitive emulsion layer | | | | | |
| Emulsion | R-1 | R-2 | R-3 | R-4 | R-5 |
| Deviation coefficient | 30% | 25% | 20% | 15% | 10% |
| Average grain size | 0.47μ | 0.48μ | 0.49μ | 0.49μ | 0.49μ |
| Shape of grain | cubic | cubic | cubic | cubic | cubic |
| Halogen composition C1% | 99.5 | 99.6 | 99.6 | 99.7 | 99.8 |

The thus-prepared samples were subjected to, after an exposure to light through an wedge, processing process shown below in which additives and composition were changed as shown in Table 2.

| Processing steps | Temperature | Time |
|---|---|---|
| Color Developing | 38° C. | 45 sec |
| Bleach-fixing | 30–35° C. | 45 sec |
| Rinse ① | 30–35° C. | 20 sec |
| Rinse ② | 30–35° C. | 20 sec |
| Rinse ③ | 30–35° C. | 20 sec |
| Drying | 70–80° C. | 60 sec |

Compositions of each processing solution used are as follows:

| | Tank Solution |
|---|---|
| Color developer | |
| Water | 800 ml |
| Nitrilo-N,N,N-trimethylene phosphonic acid (40%) | 8.5 ml |
| Additives (See Table 2) | 0.5 g |
| 1-Hydroxyethylidene-1,1-diphosphonic acid (60%) | 1.0 ml |
| Diethylenetriaminepentaacetic acid | 1.0 g |
| Potassium bromide | 0.03 g |
| Sodium chloride | See Table 2 |
| Triethanolamine | 8.0 g |
| Sodium chloride | 1.4 g |
| Potassium carbonate | 25 g |
| N-ethyl-N-(β-methanesulfonamidoethyl)-3-methyl-4-aminoaniline sulfate | 5.0 g |
| Diethylhydroxylamine | 5.5 g |
| Fluorescent brightening agent (4,4-diaminostilbene series) | 1.0 g |
| Water to make | 1000 ml |
| pH | 10.00 and 10.15 |
| Bleach-fixing solution | |
| Water | 400 ml |
| Ammonium thiosulfate (70%) | 100 ml |
| Sodium sulfite | 17 g |
| Iron (III) ammonium ethylene-diaminetetraacetate | 55 g |
| Disodium ethylenediaminetetraacetate | 5 g |
| Ammonium bromide | 40 g |
| Water to make | 1000 ml |
| pH (25° C.) | 6.0 |

Rinse Solution

Ion-exchanged Water (Contents of Calcium and Magnesium Each are 3 ppm or Below)

The change of magenta sensitivity (amount of change in logE, ΔS) was determined by changing the pH of color developer from 10.00 to 10.15, and processed in each level.

Further, the change of magenta gradation (amount of change of density at higher exposure to light by 0.3 in logE from the point of density 0.5, ΔH) was determined by the same processing in which the amount of diethylhydroxylamine was changed from 5.5 g to 4.0 g (at the pH of 10.00).

TABLE 2

| | Additive | Sodium chloride (mol/l) | Sample 1 | | Sample 2 | | Sample 3 | | Sample 4 | | Sample 5 | |
|---|---|---|---|---|---|---|---|---|---|---|---|---|
| | | | Δ S | Δ H | Δ S | Δ H | Δ S | Δ H | Δ S | Δ H | Δ S | Δ H |
| 1 | — | 0.030 | +0.07 | +0.12 | +0.07 | +0.12 | +0.07 | +0.12 | +0.07 | +0.11 | +0.07 | +0.11 |
| 2 | — | 0.035 | +0.07 | +0.12 | +0.07 | +0.12 | +0.07 | +0.12 | +0.06 | +0.11 | +0.06 | +0.11 |
| 3 | — | 0.040 | +0.07 | +0.11 | +0.07 | +0.12 | +0.07 | +0.11 | +0.06 | +0.11 | +0.06 | +0.11 |
| 4 | EX-2 | 0.030 | +0.07 | +0.12 | +0.07 | +0.12 | +0.04 | +0.06 | +0.03 | +0.05 | +0.02 | +0.02 |
| 5 | " | 0.040 | +0.07 | +0.11 | +0.07 | +0.11 | +0.01 | +0.01 | +0 | +0 | +0 | +0 |
| 6 | EX-4 | 0.030 | +0.07 | +0.12 | +0.07 | +0.12 | +0.02 | +0.05 | +0.02 | +0.04 | +0.02 | +0.02 |
| 7 | " | 0.040 | +0.07 | +0.11 | +0.07 | +0.11 | 0 | +0.01 | 0 | 0 | 0 | 0 |
| 8 | EX-6 | 0.030 | +0.07 | +0.12 | +0.07 | +0.12 | +0.02 | +0.06 | +0.02 | +0.04 | +0.02 | +0.02 |
| 9 | " | 0.035 | +0.07 | +0.11 | +0.07 | +0.11 | +0.02 | +0.03 | +0.02 | +0.02 | +0.01 | +0.01 |
| 10 | " | 0.040 | +0.07 | +0.11 | +0.07 | +0.11 | 0 | 0 | 0 | 0 | 0 | 0 |
| 11 | EX-10 | 0.030 | +0.07 | +0.12 | +0.07 | +0.12 | +0.03 | +0.07 | +0.03 | +0.05 | +0.03 | +0.03 |
| 12 | " | 0.040 | +0.07 | +0.11 | +0.07 | +0.11 | 0 | +0.02 | 0 | +0.02 | 0 | +0.02 |
| 13 | EX-16 | 0.030 | +0.07 | +0.12 | +0.07 | +0.12 | +0.03 | +0.06 | +0.03 | +0.05 | +0.02 | +0.04 |
| 14 | " | 0.040 | +0.07 | +0.11 | +0.07 | +0.11 | 0 | +0.02 | 0 | +0.02 | 0 | +0.01 |
| 15 | EX-29 | " | +0.07 | +0.11 | +0.07 | +0.11 | +0.02 | +0.03 | +0.02 | +0.02 | +0.01 | +0.01 |
| 16 | EX-34 | " | +0.07 | +0.11 | +0.07 | +0.11 | +0.02 | +0.03 | +0.02 | +0.02 | +0.01 | +0.01 |
| 17 | EX-40 | " | +0.07 | +0.11 | +0.07 | +0.11 | +0.02 | +0.03 | +0.02 | +0.02 | +0.01 | +0.01 |
| 18 | EX-45 | " | +0.07 | +0.11 | +0.07 | +0.11 | +0.02 | +0.03 | +0.02 | +0.02 | +0.01 | +0.01 |
| 19 | EX-46 | " | +0.07 | +0.11 | +0.07 | +0.11 | +0.02 | +0.03 | 0 | 0 | 0 | 0 |
| 20 | EX-51 | " | +0.07 | +0.11 | +0.07 | +0.11 | +0.02 | +0.04 | 0 | 0 | 0 | 0 |
| 21 | EX-56 | " | +0.07 | +0.11 | +0.07 | +0.11 | +0.02 | +0.04 | 0 | 0 | 0 | 0 |
| 22 | EX-60 | " | +0.07 | +0.11 | +0.07 | +0.11 | +0.02 | +0.03 | 0 | 0 | 0 | 0 |
| 23 | EX-65 | " | +0.07 | +0.11 | +0.07 | +0.11 | +0.02 | +0.04 | +0.01 | +0.01 | 0 | 0 |

The values surrounded by squares denote the results according to the present invention.

According to the present invention, the dependence on pH and diethylhydroxylamine is remarkably improved. Especially, the effect is conspicuous when the concentration of chloride ions is 0.035 mol/l or more. It is particularly effective in Samples 4 and 5, wherein the deviation coefficient is small.

EXAMPLE 2

Samples were prepared by changing the coating amount of silver of Sample 2 and Sample 5 in Example 1 as the above, thereby preparing Samples 2-A, B, C, D, E, and F.

| Sample | 2-A | 2-B | 2-C | 2-D | 2-E | 2-F |
|---|---|---|---|---|---|---|
| Emulsion | Sample 2 | The same as left | The same as left | Sample 5 | The same as left | The same as left |
| Blue-sensitive layer | 0.30 | 0.30 | 0.35 | 0.30 | 0.30 | 0.35 |
| Green-sensitive layer | 0.20 | 0.22 | 0.22 | 0.20 | 0.22 | 0.22 |

-continued

| Sample | 2-A | 2-B | 2-C | 2-D | 2-E | 2-F |
|---|---|---|---|---|---|---|
| Emulsion | Sample 2 | The same as left | The same as left | Sample 5 | The same as left | The same as left |
| Red-sensitive layer | 0.20 | 0.23 | 0.23 | 0.20 | 0.23 | 0.23 |
| Total ($g/m^2$) | 0.70 | 0.75 | 0.80 | 0.70 | 0.75 | 0.80 |

Then, after Sample 2D was exposed to light imagewise, it was continuously processed (running test) in the following processing steps until the replenishment of the color developer reached twice the tank volume.

Samples 2A to 2F were exposed to light through an wedge and then were processed before and after the running test, and the changes in sensitivity of magenta and the gradation from those at the start were determined as in Example 1.

Further, after the running test was finished, each sample was subjected to a uniform exposure to light so as to be the density about 0.3 through a processed unexposed color negative film (Super HG400, made by Fuji Photo Film Co., Ltd.) by using Fuji Color Printer FAP 3500, and the density difference (ununiformity after processing) between the maximum density and minimum density of processed print was determined by measuring the gray density.

| Processing step | Temperature | Time | Amount of Replenisher* | Tank capacity |
|---|---|---|---|---|
| Color developing | 38° C. | 45 sec | 72 ml | 17 l |
| Bleach-fixing | 30–35° C. | 45 sec | 60 ml | 17 l |
| Rinse ① | 30–35° C. | 20 sec | — | 10 l |
| Rinse ② | 30–35° C. | 20 sec | — | 10 l |
| Rinse ③ | 30–35° C. | 20 sec | — | 10 l |
| Rinse ④ | 30–35° C. | 30 sec | 200 ml | 10 l |
| Drying | 70–80° C. | 60 sec | | |

*Amount of replenisher is per $m^2$ of photographic material

As color developer the following three formulations of A, B, and C were used, and the running tests were conducted for each developer. (Three tanks countercurrent mode from rinse ④ to ① was used.)

The compositions of each processing solution were as follows:

| Color developer | Tank Solution | Replenisher |
|---|---|---|
| Water | 800 ml | 800 ml |
| 1-Hydroxyethylidene-1,1-diphosphnic acid (60%) | 1.0 g | 1.0 g |
| Diethylenetriaminepentaacetic acid | 1.0 g | 1.0 g |
| Nitrilotrimethylenephosphonic acid (40%) | 7.0 g | 7.0 g |
| Potassium bromide | 0.02 g | — |
| Triethanolamine | 8.0 g | 12.0 g |
| Sodium chloride | 4.0 g | — |
| Potassium carbonate | 25 g | 25 g |
| N-ethyl-N-(β-methanesulfonamidoethyl-3-methyl-4-aminoaniline sulfonate | 5.0 g | 11.0 g |
| N,N-Bis(carboxymethyl)hydrazine | 5.5 g | 9.0 g |
| Fluorescent brightening agent (WHITEX-4B, made by Sumitomo Chemical Ind. Co.) | 1.0 g | 6.0 g |
| Water to make | 1000 ml | 1000 ml |
| pH (25° C.) | 10.05 | 10.75 |

Color developer B

EX-3 in an amount of 0.1 g/l was added to color developer A both tank solution and replenisher.

Color developer C

EX-51 in an amount of 0.2 g/l was added to color developer A both tank solution and replenisher.

| Bleach-fixing solution | Solution | Replenisher |
|---|---|---|
| Water | 400 ml | 400 ml |
| Ammonium thiosulfate (70%) | 100 ml | 200 ml |
| Sodium sulfite | 17 g | 34 g |
| Iron (III) ammonium ethylenediamine-tetraacetate | 55 g | 110 g |
| Disodium ethylenediamine-tetraacetate | 5 g | 10 g |
| Water to make | 1000 ml | 1000 ml |
| pH (25° C.) | 6.0 | 4.7 |

Rinse Solution
(Both Tank Solution and Replenisher)

Ion-exchanged Water (Contents of Calcium and Magnesium Each are 3 ppm or Below)

The results are shown in Table 3.

According to the present invention, it can be understood that when Samples 2-D, 2-E, and 2-F, containing monodisperse emulsions, are processed with color developers B and C, having water-soluble polymeric compounds of the present invention, the changes in sensitivity and gradation and the ununiformity of developed density involved in the running are remarkably improved.

Particularly Samples 2-D and 2-E, wherein the coating amount of silver is 0.75 g/$m^2$ or less, show particularly good results.

Further, when the liquid interface of the color development tank was observed after the completion of each running, in the case of Processing A, a conspicuous deposit adhered to the rack and the processing tank, while in the case of Processing B and C, little deposit was observed, indicating a good state.

TABLE 3

| Color developer | Item | Sample 2-A | 2-B | 2-C | 2-D | 2-E | 2-F |
|---|---|---|---|---|---|---|---|
| A | ΔS | -0.05 | -0.05 | -0.05 | -0.04 | -0.04 | -0.04 |
| | ΔH | +0.08 | +0.08 | +0.08 | +0.07 | +0.07 | +0.07 |
| | Ununiformity of developed density | 0.12 | 0.13 | 0.14 | 0.11 | 0.12 | 0.13 |
| B | ΔS | -0.04 | -0.04 | -0.04 | 0 | -0.01 | -0.02 |
| | ΔH | +0.07 | +0.07 | +0.07 | 0 | +0.01 | +0.03 |
| | Ununiformity of developed density | 0.12 | 0.12 | 0.11 | 0.02 | 0.03 | 0.05 |
| C | ΔS | -0.04 | -0.04 | -0.05 | 0 | 0 | -0.03 |
| | ΔH | +0.07 | +0.08 | +0.07 | 0 | +0.01 | +0.03 |
| | Ununiformity of developed density | 0.14 | 0.13 | 0.14 | 0 | 0.02 | 0.05 |

The values surrounded by squares denote the results according to the present invention.

Fluctuation of photographic properties and ununiformity of developed density that will take place when a color photographic material is continuously processed can be prevented and the occurrence of deposits on the wall surface of a processing tank, particularly deposits over the gas/liquid interface, can be prevented.

In particular, when the coating amount of silver is decreased, when the halogen composition is high in silver chloride, and when the concentration of chlorine ions in a color developer is made high, the method of the present invention is effective. Especially, a polyether compound is preferable.

The method for processing a silver halide color photographic material of the present invention can prevent the occurrence of fluctuations of photographic properties and ununiformity of developed density at the time of rapid processing and continuous processing. The method is a suitable processing method to be carried out in a mini-lab, wherein fluctuations of processing conditions are relatively large and the delivery of finished products and demand for quality are severe.

What is claimed is:

1. A method for processing an imagewise exposed silver halide color photographic material comprising a support having thereon one or more light-sensitive silver halide emulsion layers, at least one layer of which contains a monodisperse emulsion of silver bromochloroiodide, silver chloride or silver bromochlioride grains containing about 30 mol % or less of silver bromide and having a ratio S/r of the standard deviation S of the grain diameter distribution to the average grain diameter r of 0.20 or below, the coating amount of silver of said photographic material is 0.75 g/m$^2$ or less, comprising the steps of continuously processing with a color developer having a chloride ion content of 0.04 to 0.15 mol/l and containing a water-soluble high polymer component, followed by desilvering and then one or both of washing and stabilizing, wherein said water-soluble high polymer component consists of a water-soluble high polymer compound which is present in an addition amount of 0.001 to 10 g per liter of the color developer and which is a homopolymer or a copolymer consisting essentially of at least one repeating unit selected from the group consisting of (i) the following repeating units

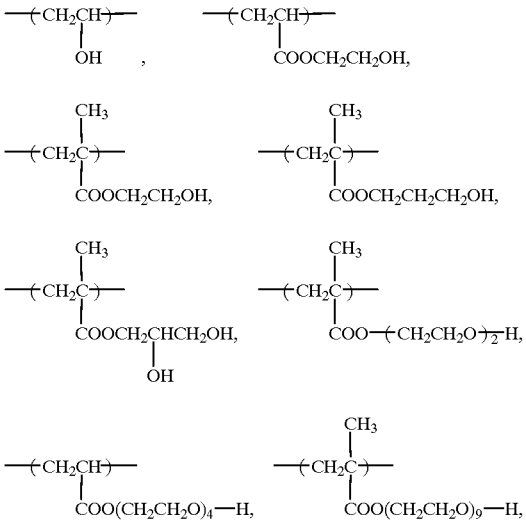

-continued

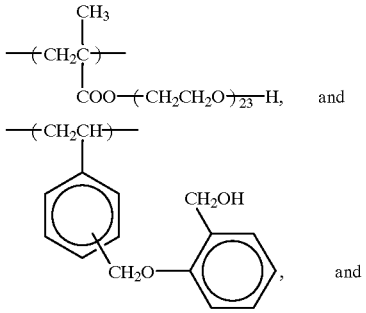

(ii) the repeating units represented by one of the following formulae (III), (IV), and (V):

Formula (III)

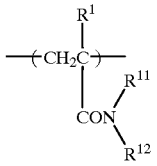

wherein $R^1$ represents a hydrogen atom or a lower alkyl group of 1 to 4 carbon atoms, $R^{11}$ and $R^{12}$ each represent a hydrogen atom, a substituted or unsubstituted alkyl group of 1 to 8 carbon atoms, or a substituted or unsubstituted aryl group of 6 to 14 carbon atoms, or $R^{11}$ and $R^{12}$ may bond together to form a ring structure;

Formula (IV)

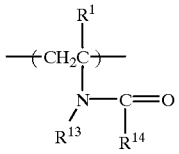

wherein $R^1$ has the same meaning as defined in formula (III) given above, $R^{13}$ and $R^{14}$ each represent a hydrogen atom or a substituted or unsubstituted alkyl group having 1 to 8 carbon atoms, or they may bond together to form a lactam ring, an oxazolidone ring, or a pyrrolidone ring, which ring structures may be substituted; and Formula (V)

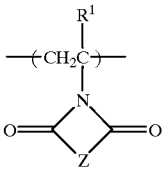

wherein $R^1$ has the same meaning as defined in formula (III) given above, and Z represents a group of atoms required to form a 5- to 7-membered ring structure, which may be substituted.

2. The method for processing a silver halide color photographic material as claimed in claim 1, wherein the silver halide of the monodisperse emulsion is silver bromochloride containing about 0.1 to about 25 mol % of silver bromide.

3. The method for processing a silver halide color photographic material as claimed in claim 1, wherein the water-soluble high polymer compound is selected from compounds having a repeating unit represented by formula (IV) or formula (V).

4. The method for processing a silver halide color photographic material as claimed in claim 1, wherein the concentration of benzyl alcohol in said color developer is 0 to 2 ml/l.

5. The method for processing a silver halide color photographic material as claimed in claim 1, wherein the concentration of sulfite ions in said color developer is 0 to $3.0\times10^{-3}$ mol/l.

6. The method for processing a silver halide color photographic material as claimed in claim 1, wherein the content of bromide ions in said color developer is $3\times10^{-5}$ to $1.0\times10^{-3}$ mol/l.

7. The method for processing a silver halide color photographic material as claimed in claim 1, wherein the time of development processing is 20 sec to 5 min.

8. The method for processing a silver halide color photographic material as claimed in claim 1, wherein the replenishing amount of the color developer is 60 to 150 ml per $m^2$ of the photographic material processed.

9. The method for processing a silver halide color photographic material as claimed in claim 1, wherein the content of an aromatic primary amine developing agent in said color developer is 0.1 to about 20 g/l.

10. The method for processing a silver halide color photographic material as claimed in claim 1, wherein the water-soluble high polymer compound is selected from compounds having a repeating unit represented by one of the repeating units of group (i) or formula (III).

11. The method for processing a silver halide color photographic material as claimed in claim 1, wherein the color developer has a chloride ion content of 0.04 to 0.15 mol/l.

12. The method for processing a silver halide color photographic material as claimed in claim 1, wherein the coating amount of silver of the photographic material is 0.4 to 0.75 $g/m^2$.

* * * * *